US007055815B2

(12) United States Patent
Sato et al.

(10) Patent No.: US 7,055,815 B2
(45) Date of Patent: Jun. 6, 2006

(54) SHEET PROCESSING APPARATUS WITH BUNDLE DELIVERY FEATURE

(75) Inventors: Kaoru Sato, Kanagawa-ken (JP); Mitsuhide Takamura, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 205 days.

(21) Appl. No.: 10/410,202

(22) Filed: Apr. 10, 2003

(65) Prior Publication Data

US 2004/0104529 A1 Jun. 3, 2004

(30) Foreign Application Priority Data

Apr. 10, 2002 (JP) ..... 2002-107515

(51) Int. Cl.
*B65H 37/04* (2006.01)

(52) U.S. Cl. ..... 270/58.11; 270/58.12; 270/58.16; 399/410

(58) Field of Classification Search ..... 270/58.08, 270/58.11, 58.12, 58.14, 58.16; 399/410
See application file for complete search history.

(56) References Cited

U.S. PATENT DOCUMENTS

| | | | | |
|---|---|---|---|---|
| 4,073,391 A | | 2/1978 | O'Brien et al. | 214/65 |
| 5,288,062 A | * | 2/1994 | Rizzolo et al. | 270/58.12 |
| 5,826,158 A | * | 10/1998 | Hirano et al. | 399/410 |
| 6,171,225 B1 | | 1/2001 | Nonoyama et al. | 493/16 |
| 6,205,297 B1 | | 3/2001 | Tachibana et al. | 399/21 |
| 6,330,999 B1 | * | 12/2001 | Coombs et al. | 270/58.18 |
| 6,382,615 B1 | * | 5/2002 | Ishiguro et al. | 270/58.12 |
| 6,427,997 B1 | * | 8/2002 | Hirota et al. | 270/58.12 |
| 6,450,492 B1 | * | 9/2002 | Coombs et al. | 270/58.08 |
| 6,540,418 B1 | | 4/2003 | Sato | 400/582 |
| 6,581,922 B1 | * | 6/2003 | Kuwata et al. | 270/58.11 |
| 6,601,840 B1 | * | 8/2003 | Boss et al. | 270/58.08 |
| 6,666,444 B1 | * | 12/2003 | Paoli | 270/58.11 |

FOREIGN PATENT DOCUMENTS

| | | |
|---|---|---|
| EP | 1 288 014 A2 | 3/2003 |
| EP | 1 336 508 A2 | 8/2003 |

* cited by examiner

*Primary Examiner*—Patrick Mackey
(74) *Attorney, Agent, or Firm*—Fitzpatrick, Cella, Harper & Scinto

(57) ABSTRACT

The present invention relates to a delivery processing apparatus for delivering a sheet after implementing a prescribed sheet processing upon aligning the sheet, and includes an aligning device for aligning a sheet, a conveying device for conveying the sheet to the aligning device and a bundle delivering device disposed on an upstream side of the aligning device in a sheet conveyance direction for delivering a sheet bundle being done with a sheet processing. The bundle delivering device is able to choose a conveyable state for conveying the sheet upon nipping the sheet and a non-conveyable state for not conveying the sheet, wherein when a first sheet among a plurality of sheets to be conveyed to the aligning device by the conveying device is conveyed the conveyable state is chosen, and wherein when a second or later sheet is conveyed the non-conveyable state is chosen.

20 Claims, 22 Drawing Sheets

(a)

(b)

SHEET PROCESSING APPARATUS WITH BUNDLE DELIVERY FEATURE

BACKGROUND OF THE INVENTION

1. Field of the Invention

This invention relates to conveyance control of a delivery processing apparatus coupled to a recording apparatus and, more particularly, to a delivery processing apparatus capable of accurately conveying sheets and an image forming apparatus having this delivery processing apparatus.

2. Description of Related Art

Image forming apparatuses such as printers conventionally include a delivery processing apparatus for delivering plural image-formed (or recorded) sheets upon processing the sheets such as stapling where each edge is aligned. Such a delivery processing apparatus is formed on a top face or a side face of a sheet delivery outlet side of an image forming apparatus body, and a type of such a delivery processing apparatus has been known as the sheets on which recording is made at the side of the image forming apparatus body, are fed sheet by sheet to a delivery processing apparatus to align each edge and to be delivered upon subjecting to processing.

The alignment operation is done after each sheet is stacked on an alignment tray. To make independent the alignment mechanism, a tray is ordinarily placed at a position one step lower than the conveyance route, and the alignment is done by an alignment mechanism upon stacking sheets on the tray.

With such a structure, however, the apparatus may be subject to demerits such that the apparatus becomes larger and costs increase. Particularly, with the printer for desktop size, the printer may suffer from many problems such as bad balance in size, conditions for installation, increased prices.

SUMMARY OF THE INVENTION

By installation of the alignment mechanism on an extension of the conveyance route, a compact delivery processing apparatus can be designed, but the alignment means requires an alignment mechanism to move in a direction perpendicular to the sheet conveyance direction, so that if the alignment mechanism is made independent on the conveyance route, the conveyance route is inevitably divided.

There raise various problems on the conveyance at the divided portions. One of such problems to be considered is jamming due to curling of the sheets. The sheets whose front end is curling may come out of the conveyance route and may disturb the sheet conveyance at the alignment mechanism.

This invention is provided to solve the above problems. It is an object of the invention to provide a delivery processing apparatus properly conveyable of sheets to an alignment portion for implementing sheet processing and an image forming apparatus having this delivery processing apparatus.

A representative structure according to the invention to accomplish the above object is a delivery processing apparatus for delivering a sheet after implementing a prescribed sheet processing upon aligning the sheet, including: an aligning means for aligning a sheet; a conveying means for conveying the sheet to the aligning means; and a bundle delivering means disposed on an upstream side of the aligning means in a sheet conveyance direction for delivering a sheet bundle done with a sheet processing, wherein the bundle delivering means is able to choose a conveyable state for conveying the sheet upon nipping the sheet and a non-conveyance state for not conveying the sheet, and wherein when a first sheet among plural sheets to be conveyed to the aligning means by the conveying means is conveyed the conveyable state is chosen whereas when a sheet of the second or later is conveyed the non-conveying state is chosen.

According to the invention, the apparatus utilizes the bundle delivering means, located on the upstream side of the aligning means, capable of choosing conveyable state and non-conveyance state, and the apparatus can convey to the aligning means without any problem the sheet even where the sheet is of a bad state such as a curled sheet or the like by rendering the bundle delivering means in the conveyable state when the first sheet among the bundled sheets to be subject to the sheet processing is conveyed to the alignment means, conveying the sheet made rigid by the bundle delivering means to the aligning means, and utilizing the sheet as a part of the conveyance route, so that the apparatus can obviate a problem, such as jamming or the like, that a user has to handle.

DETAILED DESCRIPTION OF THE PREFERRED EMBODIMENTS

Next, with a delivery processing apparatus according to an embodiment of the invention, a laser beam printer is described as an example for an image forming apparatus having the delivery processing apparatus.

[First Embodiment]

Figure 1:
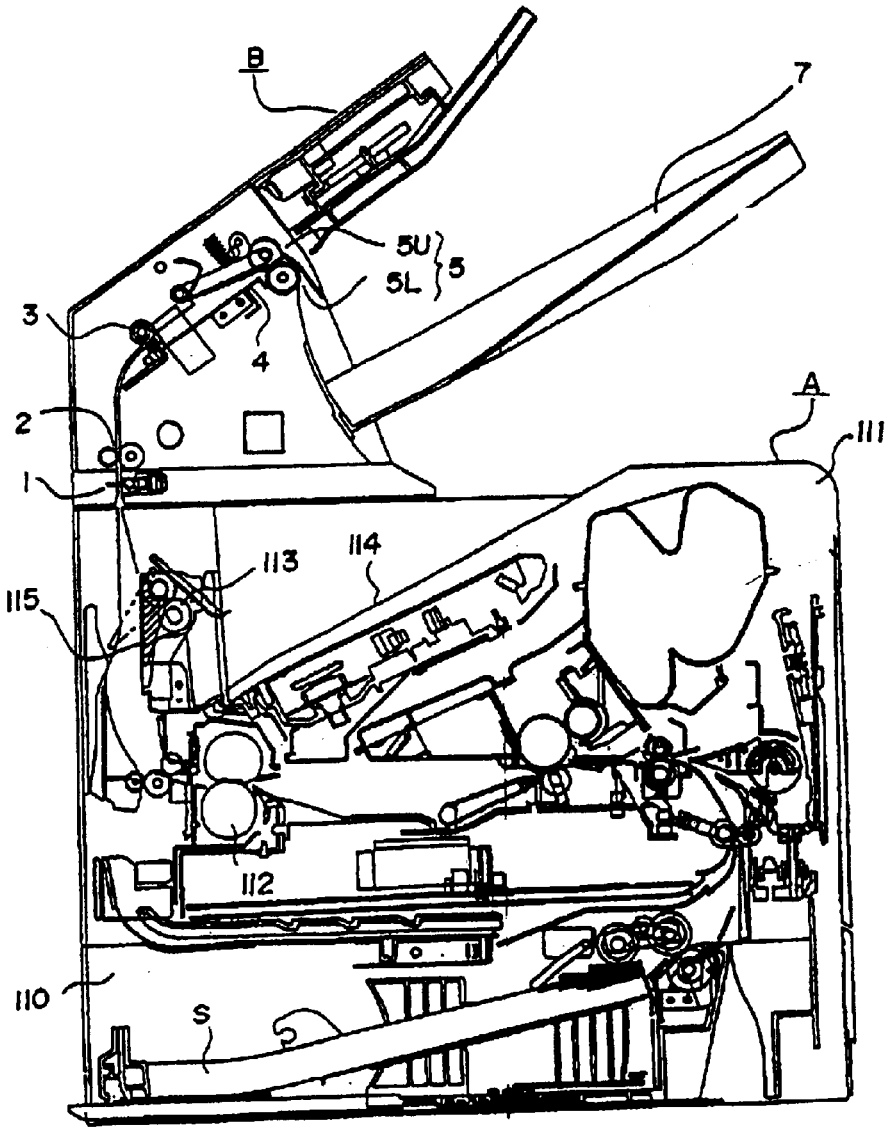
FIG. 1 is a cross section showing an image forming apparatus having an delivery processing apparatus.
Figure 2:
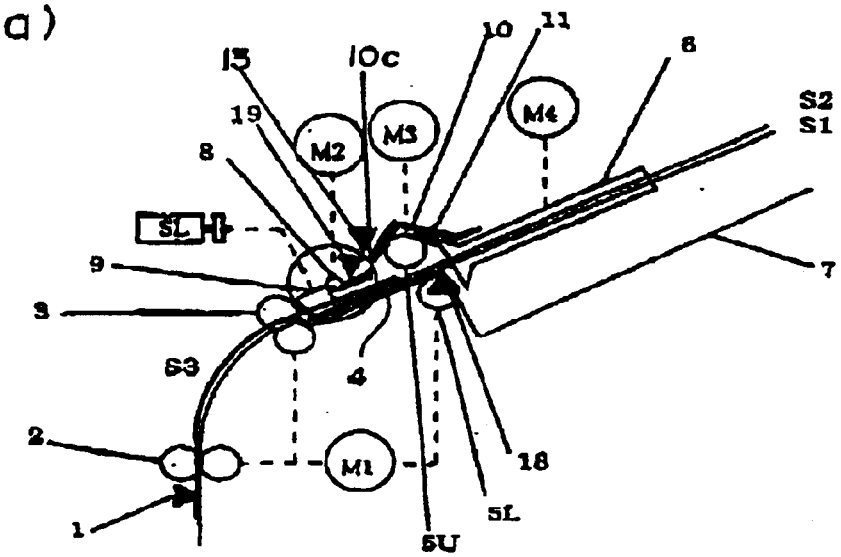
FIGS. 2(*a*) and 2(*b*) are illustrations showing cross sections of a conveyance route of the delivery processing apparatus according to the invention.
Figure 2:
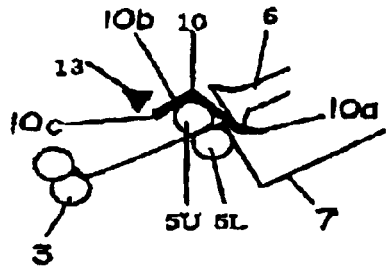
Figure 3:
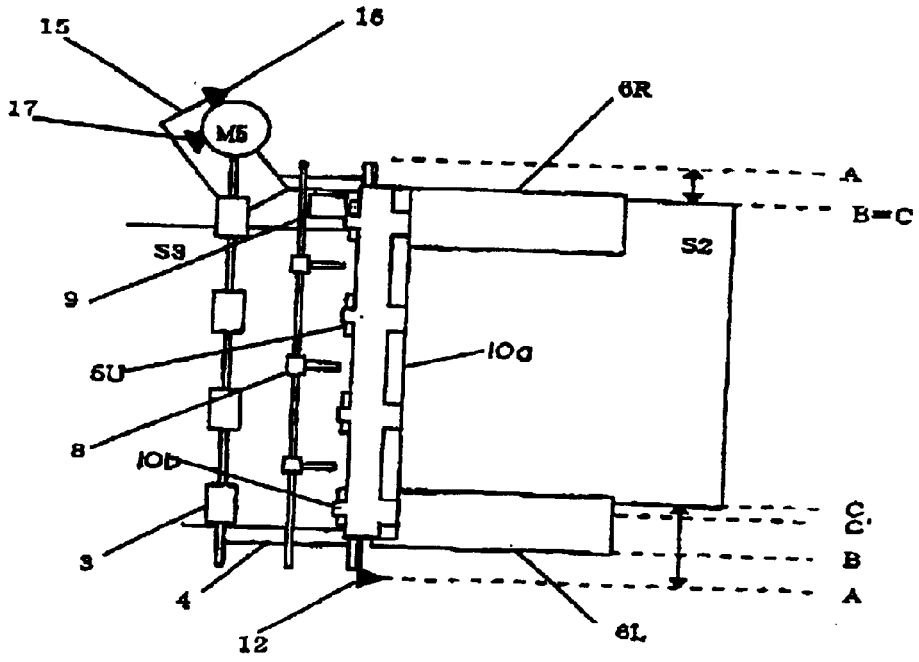
FIG. 3 is a plan illustration showing an alignment processing portion.
Figure 4:
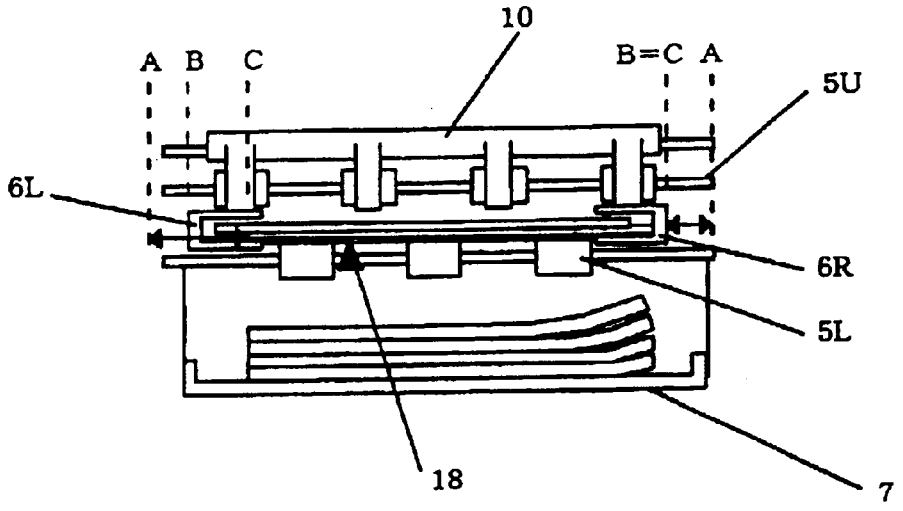
FIG. 4 is a cross-sectional illustration showing the alignment processing portion when seen in a direction of a delivery outlet.
Figure 5:
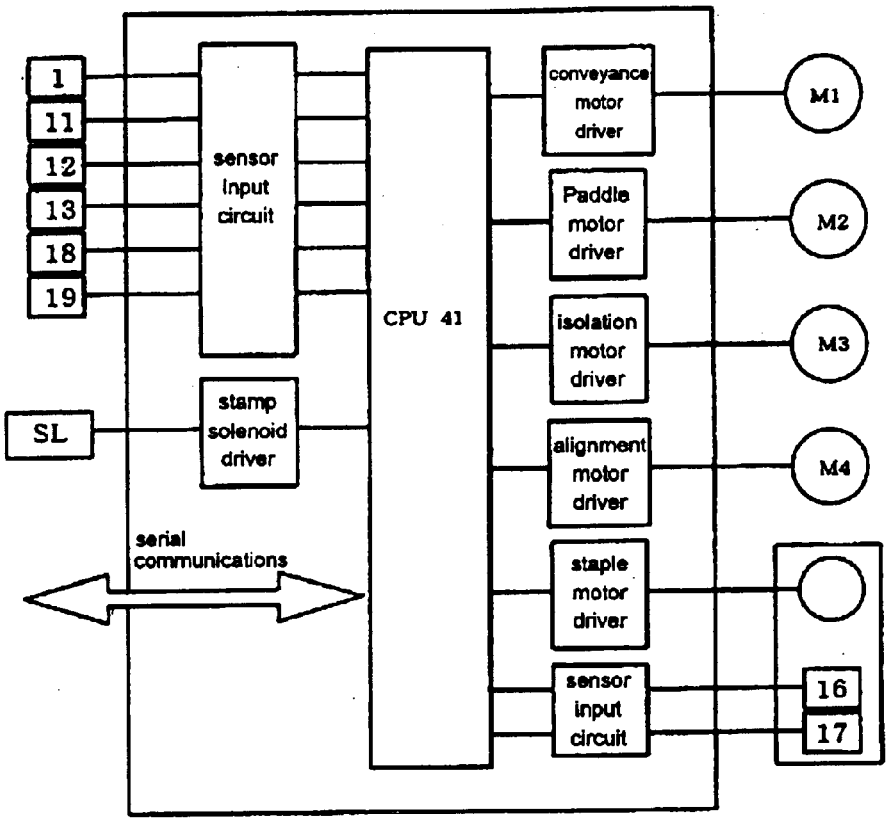
FIG. 5 is an electrical block diagram.

FIG. 1 is a cross section showing an image forming apparatus having an delivery processing apparatus; FIG. 2 is an illustration showing a cross section of a conveyance route of the delivery processing apparatus according to the invention; FIG. 3 is a plan illustration showing an alignment processing portion; FIG. 4 is a cross-sectional illustration showing the alignment processing portion when seen in a direction of a delivery outlet; FIG. 5 is an electrical block diagram.

{The Whole Structure of the Image Forming Apparatus Having the Delivery Processing Apparatus}

First, referring to FIG. 1, outlined structures of the image forming apparatus A and the delivery processing apparatus B are described. The image forming apparatus A is solely connected to a computer or to a network such as a LAN or the like, and is an apparatus forming (or recording) images on a sheet through a prescribed image forming process based on such as image information or printer signals transmitted from the computer or the network and delivering the sheet.

With the image forming apparatus A, plural sheets S are stacked in a feeding cassette 110, and a variety of rollers feeds separately the topmost sheet one by one among the stacked sheets. According to the prescribed print signal fed from the computer or the network, toner images are transferred to a top side of the sheet at an image forming section 111 at which toner images are formed with an image forming processing of a so-called laser beam method to the sheet S fed from the feeding cassette 110 in the image forming apparatus A, and subsequently, the toner images are fixed in application of heat and pressure at a fixing unit 112 located on a downstream side.

The sheet S to which the images are fixed is turned at a sheet conveyance route in a substantially U-shape extending to the delivery roller 113 as to reverse the imaged side, and is delivered as the image side faces down to a face down delivery tray 114 formed at a top of the image forming apparatus A by the delivery roller 113. The sheets S are selectively delivered to the face down delivery tray 114 or the delivery processing apparatus B by selection of a position of a flapper 115 in the image forming apparatus A based on the control signal from a controller, not shown.

The delivery processing apparatus B is disposed at an upper portion of the image forming apparatus A, for performing a prescribed sheet processing such as stapling or punching to the sheets delivered upon which images are recorded at the image forming apparatus A where the plural sheets are aligned to form a sheet bundle. The delivery processing apparatus B also have a function to simply make delivery and stacking without executing sheet processing. The delivery processing apparatus B and the image forming apparatus A are electrically coupled to each other with a cable connector, not shown, and the delivery processing apparatus B is detachably attached to the image forming apparatus A.

{Delivery Processing Apparatus}

Referring to FIGS. 2(*a*) and 2(*b*), the structure of the delivery processing apparatus B is described. As shown in FIG. 2(*a*), the sheet supplied from the image forming apparatus A is detected by an inlet sensor 1, conveyed by a conveyance roller 2, and conveyed to an alignment stage 4 by an intermediate roller 3 as a conveying means. The sheet is selectively set apart and nipped with a bundle delivery roller pair 5 (5L, 5U) as a bundle delivery means and is delivered to a stacking tray 7 after a prescribed sheet processing is made.

The rotations of the conveyance roller 2, the intermediate roller 3, the bundle delivery lower roller 5L, the bundle delivery upper roller 5U are driven by a conveyance motor M1. Nipping and separating positions of the bundle delivery roller pair 5 are determined by a cam driven by a separation motor M3. The cam is coupled to the positional sensor flag, and the position at which the flag shields a bundle delivery roller home position sensor 11 as a photosensor is the separating position whereas the position at which allowing transmission is the nipping position.

Numeral 6 is an alignment plate as an alignment member of an aligning means for aligning the sheet bundle in a lateral direction, and is positioned with a alignment motor M4 (stepping motor). The alignment plate 6 is constituted of a left alignment plate 6L for pushing the sheet left edge and a right alignment plate 6R for sheet right edge as shown in FIG. 3, and moves to any of an escaping position A, a waiting position B, an aligning position C, and a loosely aligning position D. An alignment plate home position sensor 12 is disposed at the escaping position A for detecting the escaping position. The right alignment plate 6R has a mechanism that the plate 6R does not move inward from the waiting position B, so that the alignment operation is done with a left alignment plate 6L solely according to the sheet sizes. The alignment plate 6, as show in FIG. 4, has a stacking surface for supporting sheets and delivers to a stacking tray 7 the processed sheet bundle by moving to an escaping position A not supporting the sheet after a prescribed sheet processing is implemented. The plate 6 escapes from the beginning to the escaping position A in a simply delivering and stacking mode without executing the sheet processing.

Numeral 7 is the stacking tray 7. Numeral 8 is a paddle for pulling back the sheet projected from the alignment stage 4 and rotates in a clockwise direction by the paddle motor M2. The paddle mechanism has a paddle home position sensor 19 used for rotation control of the paddle motor M2.

Numeral 9 is a stamp for pressing the aligned sheet bundles and is isolated and made to press with a solenoid SL in a plunger type. When the solenoid SL is turned on, the stamp is isolated, whereas when the solenoid SL is turned off, the stamp is moved down to press.

Numeral 10 is a fully stacking detection sensor flag and has a plate shape structure whose opposite ends 10*a*, 10*b* are folded, where the stacking detection flag 10 moves pivotally with formation of a pivotal shaft 10*c* located at one end of upstream side. The fully stacking detection sensor flag 10 is positioned over the bundle delivery upper roller 5U and shields a fully stacking detection sensor 13 when the sheets on the stacking tray 7 reach the fully stacking level while the bundle delivery roller pair 5 is in a nipping state. The fully stacking detection sensor flag 10 has a structure that escapes upward by a drive apparatus, as shown in FIG. 2(*a*) where the bundle delivery roller pair 5 is being isolated, and therefore, enters in a non-detection state at which the fully stacking detection is prohibited. As shown in FIG. 4, the fully stacking detection sensor flag 10 is also arranged not only at the center of the sheet but also at the opposite ends to accurately detect the rising of the sheet bundle at the staple position. It is therefore turned out that the operation ranges of the alignment plate 6 and the fully stacking detection sensor flag 10 are interfering to (or overlapping to) each other.

It is to be noted that as shown in FIG. 2(*b*), where alignment operation ends, where the alignment plate 6 returns to the home position, and where the bundle delivery roller pair 5 comes to nip, the fully stacking detection sensor flag 10 moves pivotally to the side of the stacking tray 7, and one end 10*a* comes in contact with the sheet bundle stacked on the stacking tray 7, thereby allowing the prescribed stacking level of the sheet bundle to be detected.

Numeral 15 is a stapler and staples in an oblique manner at right rear portion of the sheet bundle aligned on the alignment stage 4 by drive of the staple motor M5. The stapler 15 includes a stapler home position sensor 16 for indicating the initial position of the stapler, and a staple existence sensor 17 for detecting a schedule of non-stapling operation.

Numeral 18 is a sheet bundle existence sensor on the alignment stage 4 and is used for judging whether the bundle delivery and stacking operation after stapling is properly done.

{Controlling Structure}

A CPU 24 in FIG. 5 is a one-chip microprocessor incorporating ROMs and RAMs and outputs drive signals to the respective drive circuits and inputs sensor signals from the respective sensor input circuits. The CPU 24 also transmits and receives control information and status information through a serial transmission to a printer controller, not shown.

Hereinafter, using the respective mechanisms of the delivery processing apparatus B as described above, how the CPU 41 controls in respect to the initializing process at power-on, the sheet conveyance management process, the sheet bundle's processing, and error detection and error processing is described in reference to flowcharts.

(1) Initializing Processing

Figure 6:
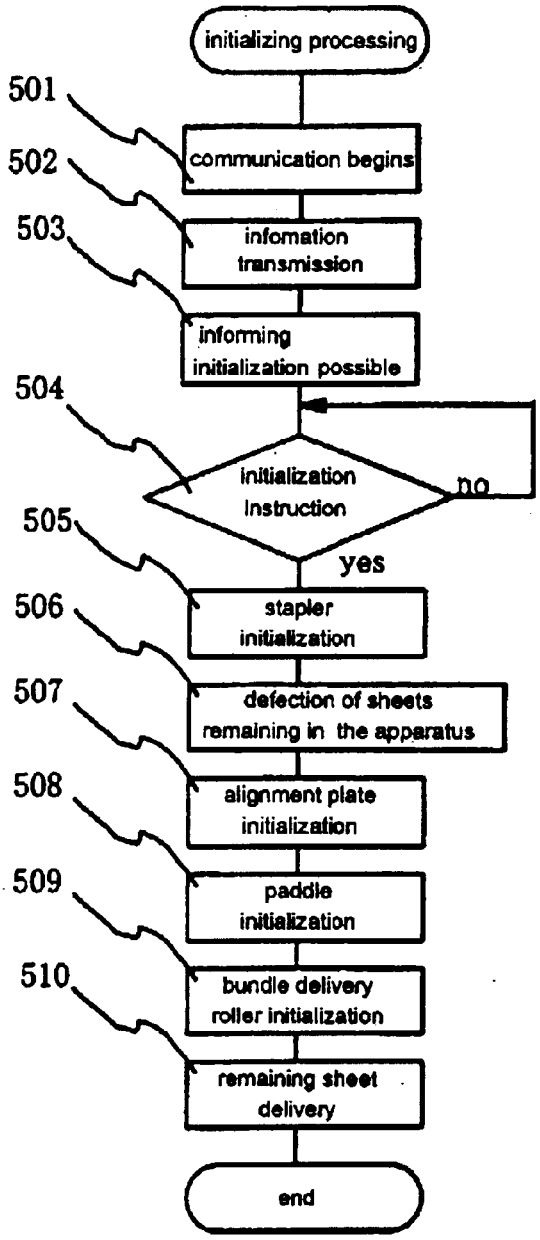
FIG. 6 is a flowchart showing an initializing processing of the apparatus.

FIG. 6 is a flowchart showing an initializing processing of the apparatus. When the power is turned on, the CPU 41 begins communications with a printer controller, not shown, at step 501. When the communications begin, the printer controller and the CPU 241 transmit and receive the apparatus information of one another at step 502.

At step 503, the initializing enabling state is informed to the printer controller, and the CPU waits the initializing instruction from the printer controller at step 504. Because the initializing processing at the printer system including the delivery processing apparatus includes detection and delivery of remaining sheets in the printer, the remaining sheets may receive damages if initialization is made solely at the delivery processing apparatus B. Therefore, the printer controller communicates with a printer engine controller, not shown, and transmits an initializing instruction to all the apparatus of the system where all the apparatus of the system can be initialized.

Upon reception of initialization instruction from the printer controller, the stapler 15 is initialized at step 505, and thereafter, a sheet detection processing remaining in the apparatus at step 506, an initializing processing of the alignment plate 6 at step 507, an initializing processing of the paddle mechanism 8 at step 508, an initializing processing of the bundle delivery roller pair 5 at step 509, and a delivery processing of a sheet remaining on the alignment stage 4 at step 510 are implemented.

This delivery processing routine is composed in consideration of the following points.

(i) The initializing processing of the alignment plate 6 is done before the initializing processing of the bundle delivery roller pair 5. The reason is: where the bundle delivery roller pair 6 is in a nipping state and where the alignment plate 6 is at an escaping position, if a user mistakenly pushes the alignment plate 6 toward the center direction, the fully stacking detection sensor flag 10 takes a positional relation as to be placed beneath the alignment plate 6; if the initializing processing of the bundle delivery roller pair 5 is made first at step 509 under this situation, the fully stacking detection sensor flag 10 and the alignment plate 6 likely interfere with each other, thereby occurring breakdown. Accordingly, the initializing processing of the alignment plate 6 has to be done prior to the initializing processing of the bundle delivery roller pair 5.

(ii) Another consideration is to implement initialization of the stapler 15 before the detection of the sheets remaining in the apparatus. The reason is as follows. The stapler 15 may be subject to an initializing processing as the stapler 15 engages with the sheet bundle or namely as in a state of so-called staple jamming. At that time, a problem may occur in which a user cannot remove the staple even where taking away of the sheet bundle because the stapler 15 is remaining as engaging with the sheet bundle where the subsequent initializing processings are stopped upon detection of the sheets remaining in the apparatus, which is judged as sheet jamming. Therefore, after the stapler 15 is initialized, the processing of sheets remaining in the apparatus has to be done.

Figure 7:
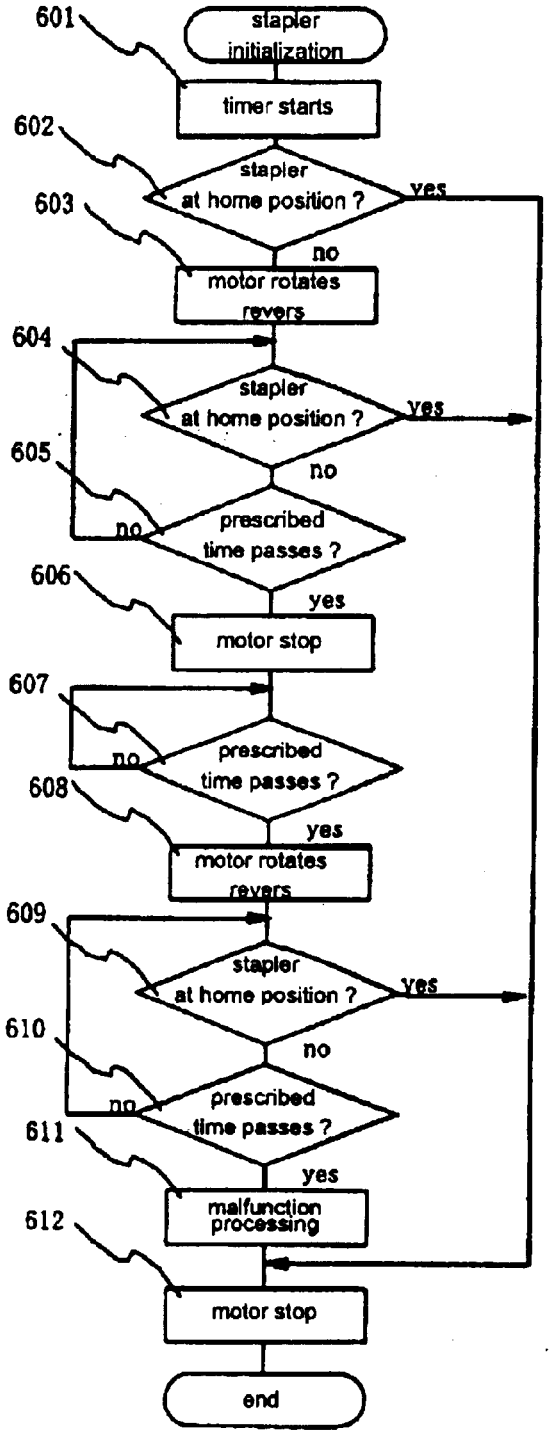
FIG. 7 is a flowchart showing an initializing processing of a stapler.

Next, the processing steps of the respective initializations are described according to flowcharts. FIG. 7 is a flowchart showing an initializing processing of the stapler.

At step 601, a timer for control is started. At step 602, the stapler home position sensor 16 of the stapler 15 is confirmed to judge as to whether the stapler 15 is in an initial state (or the stapler 15 is located at the home position). If the stapler is not in the initial state, a stapler recovery processing is made at step 603. The stapler recovery processing is implemented by rotating the stapler motor MS for a prescribed period in a reverse direction to that for making staples. At steps 604, 605, the stapler home position sensor 16 of the stapler 15 is confirmed for a prescribed period to find out that the stapler 15 returns to the initial state. If the staple 15 is not detected as positioned at the home position, the staple motor M5 is stopped at step 606, and the operation is stopped for a prescribed period at step 607. The staple motor M5 operates in the reverse direction again at step 608 to implement the stapler recovery processing again at steps 609, 610 in the same manner as in steps 604, 605. When the stapler home position is still not confirmed at step 609, the stapler malfunction processing at step 611 is executed. If the stapler home position is detected at steps 602, 604, 609, the initializing processing of the stapler 15 finishes, and the staple motor M5 is stopped at step 612. In the stapler malfunction processing at step 611, malfunction of the stapler is informed to the printer controller, not shown, and all of the initializing processings are stopped.

Figure 8:
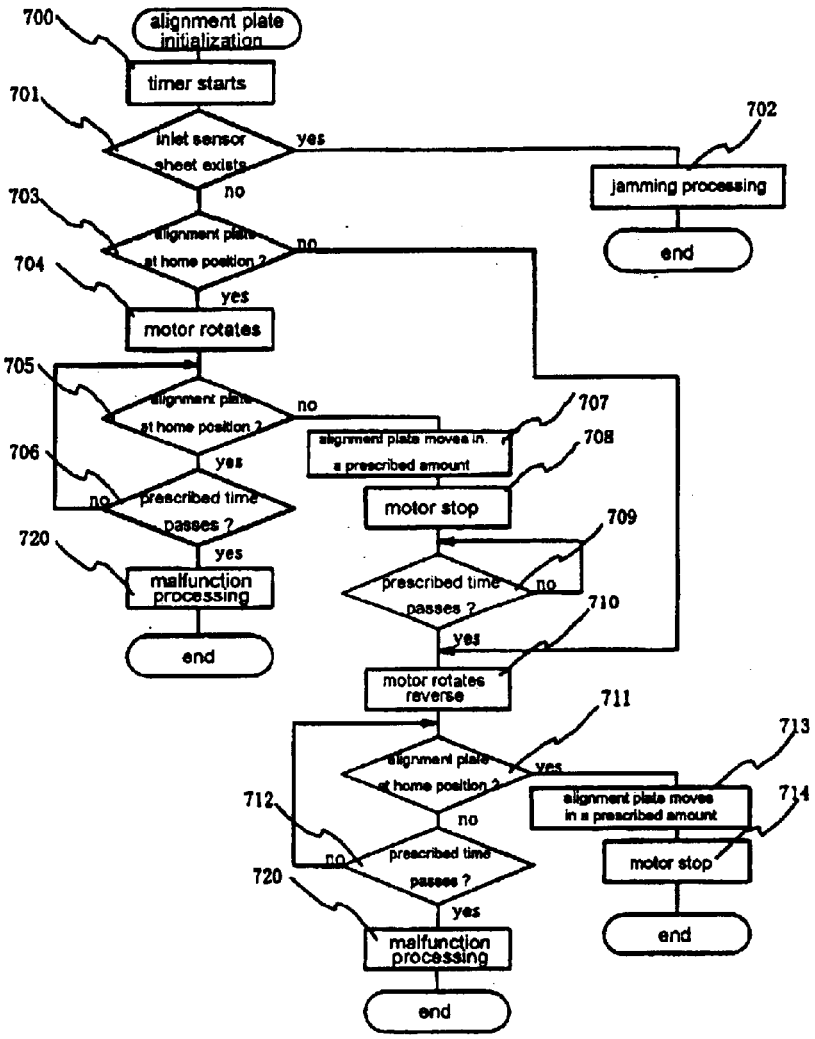
FIG. 8 is a flowchart showing an remaining sheet detection processing in the apparatus and an alignment plate initializing processing.

FIG. 8 is a flowchart showing a detection processing of sheets remaining in the apparatus and an alignment plate initializing processing.

At step 700, the timer for control is started. At step 701, the inlet sensor 1 is confirmed as to judge whether the sheet is remaining in the delivery processing apparatus B. If any sheet remains, a jamming processing for sheets remaining in the apparatus is implemented at step 702. The jamming processing is to inform the jamming to the printer controller, not shown, and to stop the subsequent initializing processings. If no remaining sheet is detected, the initializing processing for the alignment plate is implemented.

First, a confirmation is made as to whether the alignment plate home position sensor 12 detects the alignment plate 6 at step 703. If it is not detected, the operation shifts to the processing at step 710. If it is detected, the alignment motor M4 is driven to rotate in a normal direction at step 704, and a confirmation is made as to whether at step 705 the alignment plate home position sensor 12 comes not to detect the alignment plate 6. Here, the drive time of the motor M4 is measured, and if it is judged as driven more than a prescribed period at step 706, a malfunction processing at step 720 is implemented upon determined as the alignment motor M4 is malfunctioning. In the malfunction processing, alignment motor's malfunction is informed to the printer controller, not shown, and the subsequent initializing processings are not executed. If it is within a prescribed period, the operation returns to the step 705. If the alignment plate home position sensor 12 comes not to detect the alignment plate 6 at step 705, the alignment motor M4 is further driven in the normal direction for a prescribed amount at step 707. After passing the ceasing processing steps 708, 709 for a prescribed period for switching the rotational direction of the motor, the alignment motor M4 is driven in the reverse direction at step 710, and a confirmation is made as to whether the alignment plate home position sensor 12 detects the alignment plate 6 at step 711. Here, the drive time of the motor M4 is also measured, and if it is judged as driven more than a prescribed period at step 712, a malfunction processing at step 720 is implemented upon determined as the alignment motor M4 is malfunctioning. If it does not yet reach the prescribed time, the operation returns to the processing at step 711.

Where the alignment plate home position sensor 12 detects the alignment plate 6 at step 711, the alignment motor M4 is driven in the reverse direction for a prescribed amount at step 713, and the motor is stopped at step 714. This is the end of the initializing processing of the alignment plate.

Figure 9:
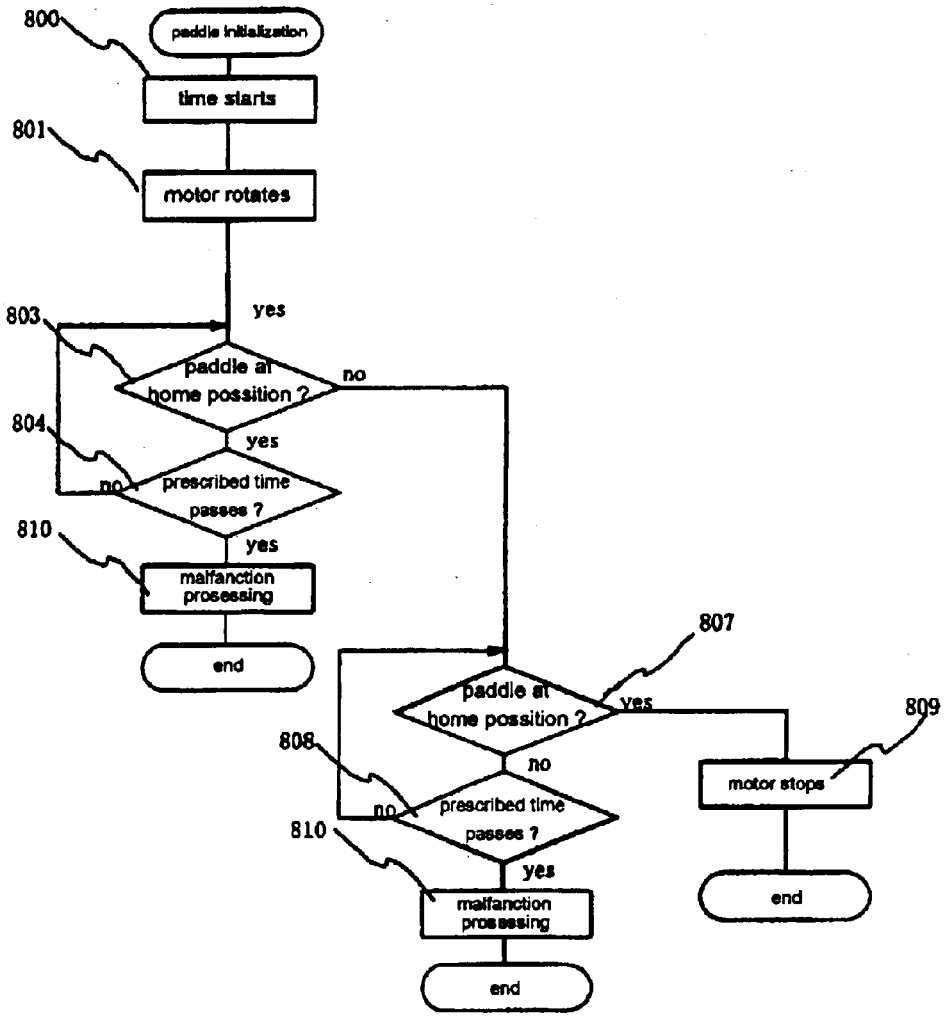
FIG. 9 is a flowchart showing an initialing processing of a paddle mechanism.

FIG. 9 is a flowchart showing an initializing processing of a paddle mechanism.

First, a timer for control is started at step 800. The paddle motor M2 is driven in a normal direction at step 801, and a confirmation is made as to whether the paddle home position sensor 19 detects a paddle sensor flag not shown but rotating together with the paddle at step 801. If it is not detected, the operation returns to the processing at the step 807. If it is detected, a confirmation is made as to whether at steps 803, 804 the paddle home position sensor 19 comes not to detect the paddle sensor flag for a prescribed period. If the sensor still detects the paddle sensor flag even where driven at the prescribed period or more, it is judged as malfunction of the alignment motor M2, and a malfunction processing at step 810 is implemented. In the malfunction processing, the malfunction of the paddle motor is informed to the printer controller, not shown, and the subsequent initializing processings are stopped.

At step 803, if the paddle home position sensor 19 comes not to detect the paddle sensor flag, the paddle motor M2 is further driven in the normal direction as it is, and at steps 807, 808, a confirmation is made as to whether the paddle home position sensor 19 detects the paddle sensor flag within a prescribed period. If it is judged as driven for the prescribed period or more at step 808, it is judged as malfunction of the paddle motor M2 to render a malfunction processing at step 810. If the paddle home position sensor 19 detects the paddle sensor flag at step 807, the paddle motor M2 is stopped at step 809, thereby finishing the initializing processing of the paddle mechanism.

Figure 10:
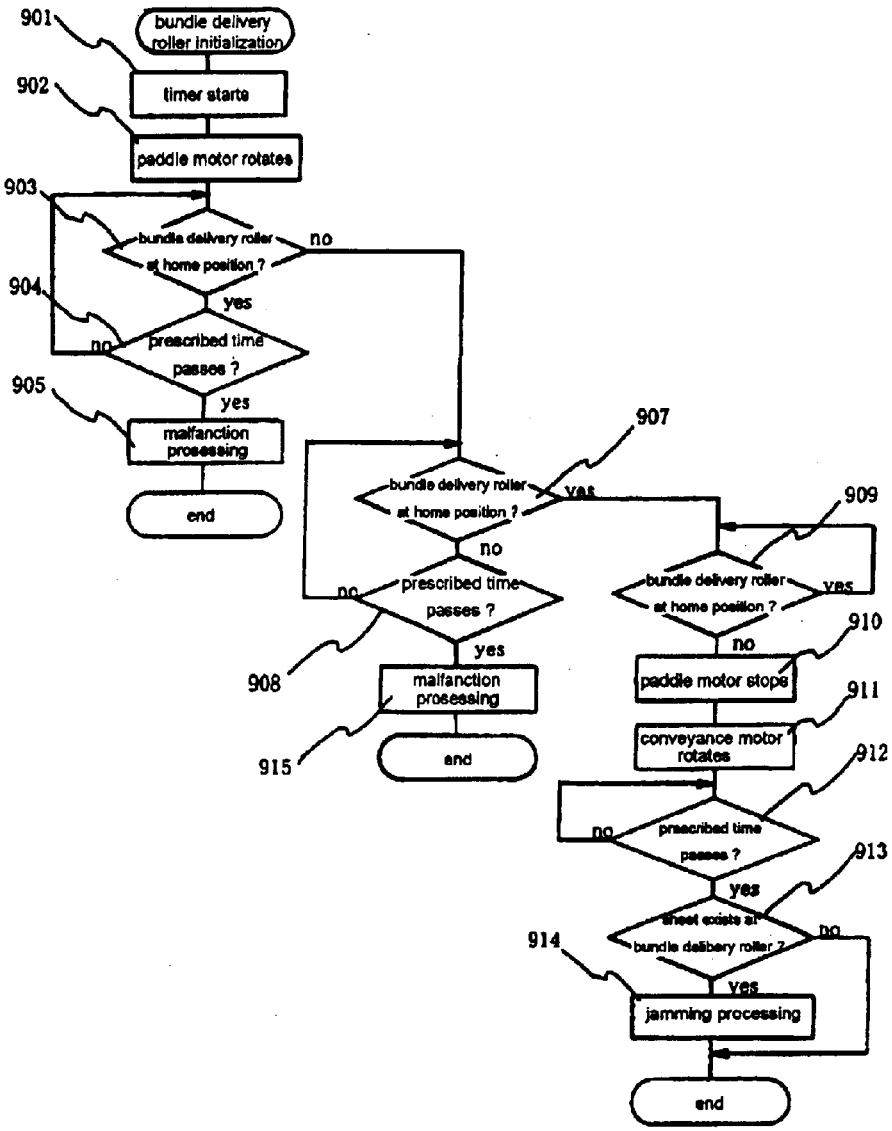
FIG. 10 is a flowchart showing an initializing processing of a bundle delivery roller and a bundle delivery proceeding.

FIG. 10 is a flowchart showing an initializing processing and a bundle delivery processing of the bundle delivery roller.

First, a timer for control is started at step 901. The isolation motor M3 is driven in a normal direction at step 902, and it is confirmed at step 903 that the bundle delivery home position sensor 11 detects the positional sensor flag, not shown, rotating together with a positioning cam for bundle delivery roller. If not detected, the operation moves to the processing at step 907.

If it is detected, it is confirmed at steps 903, 904 that the bundle delivery home position sensor 11 comes not to detect the positional sensor flag. If it is judged that the motor is driven for a prescribed period or more at step 904, it is judged as malfunction of the isolation motor M3 to implement malfunction processing at step 905. In the malfunction processing, the malfunction of the isolation motor is informed to the printer controller, not shown, and the subsequent initializing processings are ceased. When the bundle delivery home position sensor 11 comes not to detect the positional sensor flag at step 903, the isolation motor M3 is driven further in the normal direction, and it is confirmed at steps 907, 908 that the paddle home position sensor 19 detects the paddle sensor flag within a prescribed period. If it is judged as driven at step 908 for the prescribed period or more, it is judged as malfunction of the isolation motor M3 to make the malfunction processing at step 915. If the bundle delivery roller home position sensor 11 detects the positional sensor flag at step 907, the rotation is continued to repeat the processing at step 909 until the bundle delivery roller home position sensor 11 comes not to detect the positional sensor flag. When the sensor comes not to detect the flag, the isolation motor M3 is stopped at step 910, thereby finishing the initializing processing of the bundle delivery roller. That is, the bundle delivery roller pair 5 reaches the end of the initializing processing as in the nipping state.

The conveyance motor M1 is driven at step 911. The drive time is also measured here, and it is confirmed at step 912 that the motor is driven for a prescribed period. Since the bundle delivery roller pair 5 is in a nipping state, and since the alignment plate 6 is in an escaping position, this processing should render the sheet bundle delivered to the stacking tray if the sheet or sheets remain on the alignment stage 4. Therefore, the bundle delivery sensor 18 is subject to confirmation at step 913, and if there is a sheet, a jamming processing for sheets remaining in the apparatus is implemented at step 914. If no sheet is found, all the initializing processings are finished here.

A stamp mechanism does not require the initializing processing specially because the solenoid SL is turned off at the port setting of the CPU 41 and because the stamp is being pushed down when turned off.

(ii) Sheet Conveyance Management Processing

Job information and page information of sheets to be loaded are sent to the CPU 41 from the printer controller, not shown, through communications before the sheet is loaded from the printer. The job information is added with processing information to be done at the job. The delivery processing apparatus B according to this embodiment has a stapling function and a simple stacking function without sheet processing, and the designation choosing one is transmitted from the printer controller as the job information. The page information is constituted of a page ID, a descriptor, and a sheet size. The page ID is an individual number assigned to each page. The descriptor is information showing a positional status of the sheet in the job, and the first page of the job is assigned with SOJ (start of job) whereas the last page of the job is assigned with EOJ (end of job).

The CPU 41 receiving the job information and page information from the printer controller stores the information and transmits a necessary sheet interval time to the printer controller. It is generally zero second, but in a case for stapling processing or the like, a prescribed staple operating time has to be ensured. The printer controller receiving the necessary sheet interval time delays the print start to the corresponding page by a designated time, thereby ensuring the sheet interval. Then, the CPU 41 waits for loading schedule instruction out of the printer controller. The loading schedule instruction is issued immediately before the sheet is loaded in the delivery processing apparatus B. The CPU 41 receiving the loading schedule instruction executes the sheet delivery processing.

Figure 11:
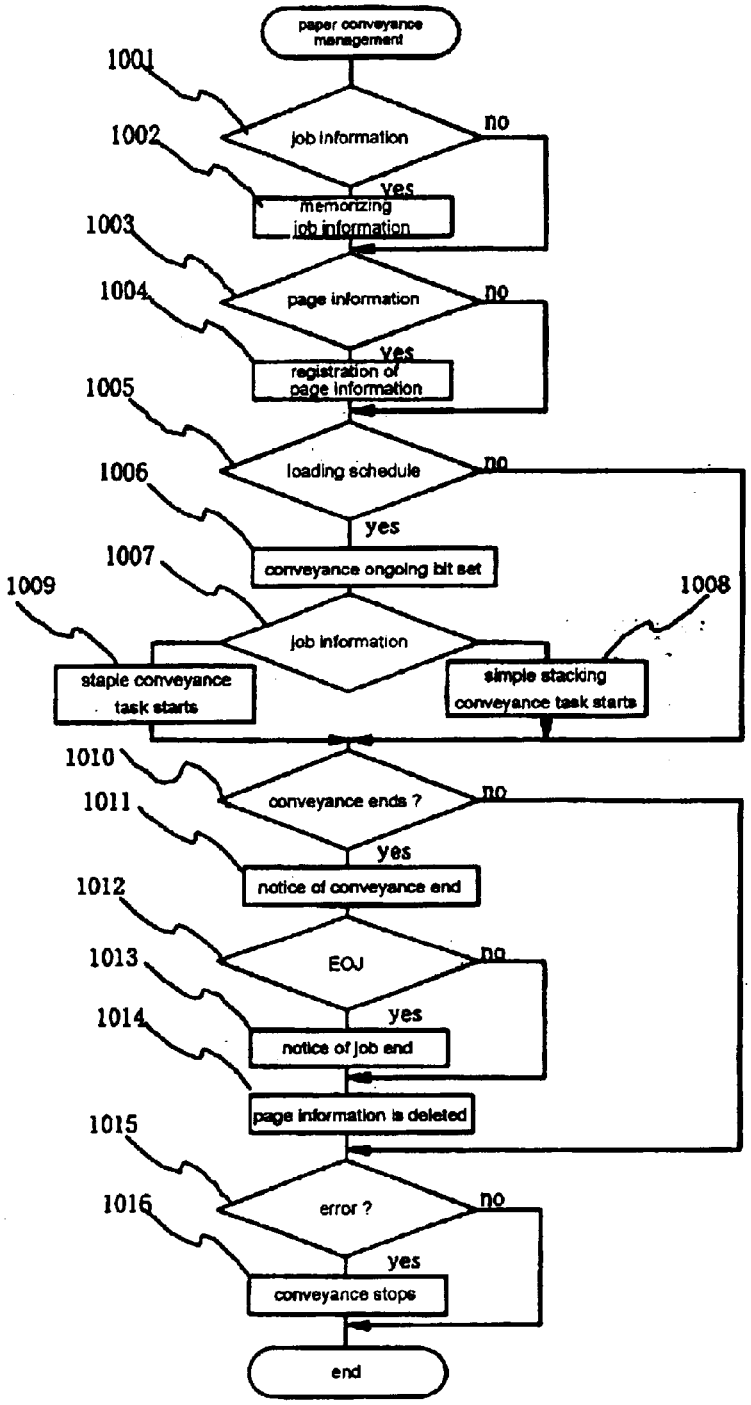
FIG. 11 is a flowchart showing a sheet conveyance management processing.
Figure 12:
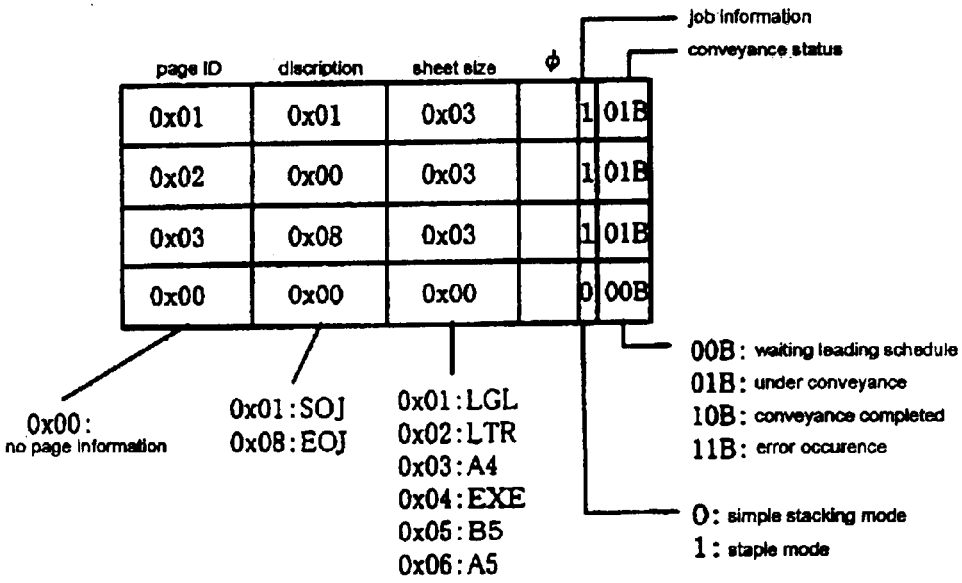
FIG. 12 is an illustration of control information for conveying the sheets in the delivery processing apparatus.

FIG. 11 is a flowchart showing a sheet conveyance managing processing. This processing is executed with a prescribed short repetitive period. At step 1001, it is judged as to whether the job information is received, and if the job information is received, the information is stored at step 1002. It is judged as to whether the page information is received, and if the information is received, the page information received at step 1004 is additionally registered to a conveyance management table. The conveyance management table is a link buffer that can register page information of four pages. The page information in the conveyance management table includes job information of one bit stored at step 1001, and conveyance information of two bits indicating the conveyance status, in addition to the page information received from the printer controller, as shown in FIG. 12. If the conveyance information is "00B", it indicates a status merely receiving the page information and not receiving the loading schedule instruction; if the conveyance information is "01B", it indicates a status that sheet conveyance operation is going on; if the conveyance information is "10B", it indicates the end of the conveyance; and if the conveyance information is "11B", it indicates occurrence of an error or errors during the conveyance.

At step 1005, it is judged as to whether the loading schedule instruction is received. If it is received, the conveyance information registered at the oldest time is sought at step 1006, and the conveyance information is assigned with "01B". At step 1007 the job information of the page information is confirmed, and if it is of the simple stacking job, a simple stacking conveying processing task is started at step 1008, but if it is of the stapling job, a stapling conveying processing task is started at step 1009. For those tasks, the address of the page information is given, and the respective tasks also perform conveyance processings based on the page information.

The conveyance management table is sought at step 1010, and the conveyance information having a data of"10B" is picked up. When the page information having the conveyance information of "10B" is found, the page ID as well as conveyance end are informed to the printer controller at step 1011. The descriptor of the page information is confirmed at step 1012, and if the EOJ is added, the end of job is informed to the printer controller at step 1013. Then, the page information is deleted from the conveyance management table at step 1014. If no conveyance information having "10B" exists at step 1010, the operation moves to the subsequent processing at step 1015.

The conveyance management table is sought at step 1015, and the conveyance information having a data of "11B" is picked up. Since the conveyance information of the data "11B"indicates conveyance error occurrence, a conveyance stop processing is made at step 1016. In the conveyance stop processing, implemented are stop and deletion of all the conveyance tasks, stop of all the drive systems such as motors, notice to the printer controller regarding the error information, and deletion of the conveyance information.

(iii) Simple Stacking Conveying Processing

Figure 13:
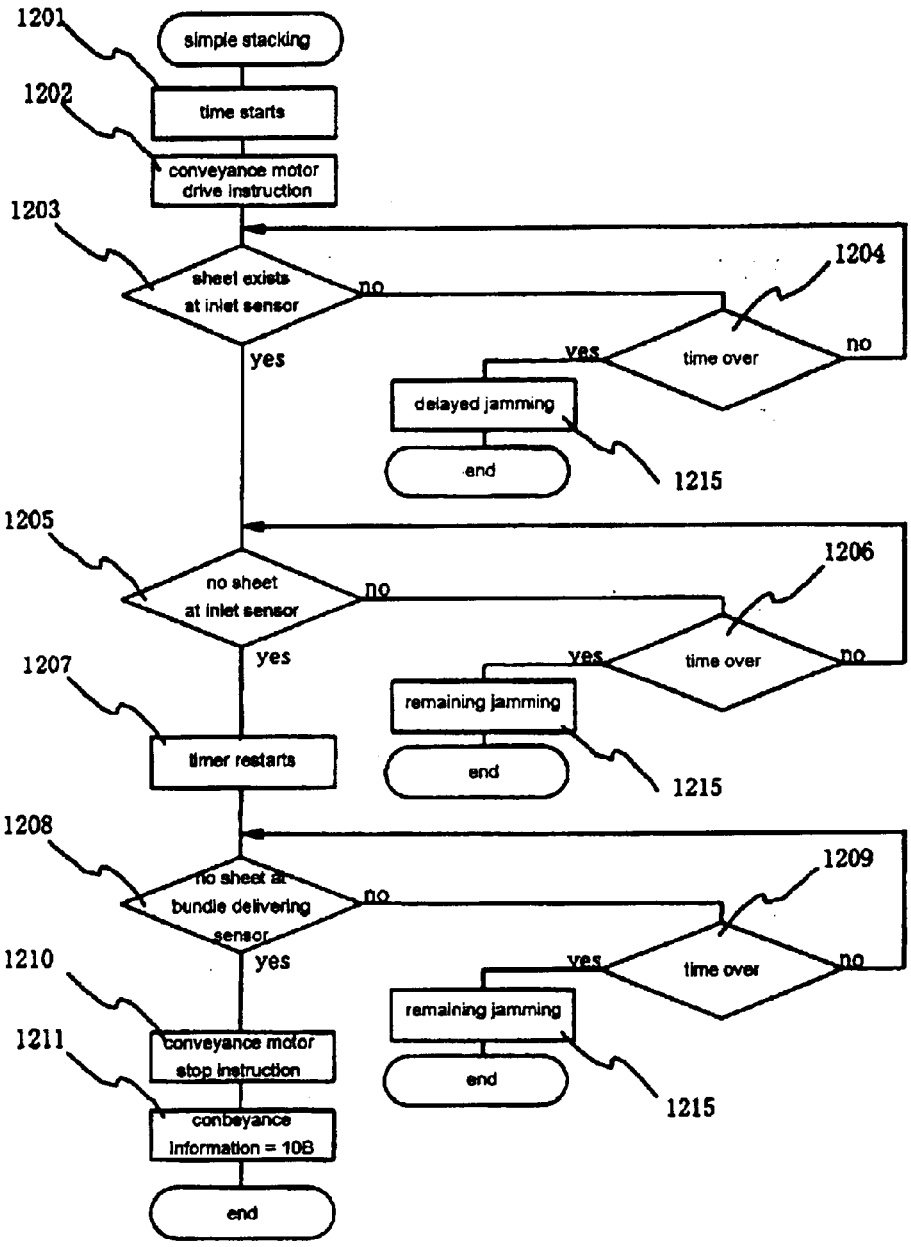
FIG. 13 is a flowchart showing a processing for simple stacking.

FIG. 13 is a flowchart showing a processing of simple stacking. This processing and the stapling conveying processing as described below are of a task processing done for each sheet, and have a program structure in which, when another sheet is loaded while one sheet's conveyance is under control, substantially the same processing task is started, and in which the processing is made in parallel with the conveyance processing for the previous page.

First, a timer begins at step 1201. A drive start instruction for the conveyance motor M1 is then given to the conveyance motor drive processing at step 1202. The inlet sensor 1 is confirmed at step 1203 to find out whether the sheet is loaded in the delivery processing apparatus B. If the sheet is not loaded in, the timer value is confirmed at step 1204, and if it passes a prescribed time or more, it is judged as delayed jamming, thereby implementing jamming processing at step 1215. If it is within the prescribed time, the operation returns to the processing at step 1203.

Where the sheet is detected at step 1203, the inlet sensor 1 is confirmed at step 1205 to find out the rear end of the sheet. If the rear end is not found out, the timer value is confirmed at step 1206, and if it passes a prescribed time set for each sheet size or more, it is judged as remaining jamming to implement jamming processing at step 1215. If it is within the prescribed time, the operation returns to the processing at step 1205.

Where the rear end of the sheet is detected at step 1205, the timer counter is reset at step 1207 to newly count the value up. Because the conveyance distance from the inlet sensor 1 to the bundle delivery sensor 18 is shorter than the smallest sheet size, the bundle delivery sensor 18 is confirmed at step 1208 to find out the rear end of the sheet. If no rear end of the sheet is found, the timer value is confirmed at step 1209, it is judged as remaining jamming to implement jamming processing at step 1215. If it is within the prescribed time, the operation returns to the processing at step 1208.

If the rear end of the sheet is detected at step 1208, the stop instruction of the conveyance motor M1 is given to the conveyance motor drive processing at step 1210. The conveyance motor drive processing not shown has an on-off counter, and when the drive start instruction is given, the on-off counter is increased by one increment whereas when the drive stop instruction is given, the on-off counter is reduced by one decrement. When the on-off counter is changed from "0" to "1", the conveyance motor M1 starts driving, whereas on-off counter is changed from "1" to "0", the conveyance motor M1 stops. With other counter values, the state of the conveyance motor is maintained. With this control, accurate conveyance processings can be done even where the plural conveyance processing tasks give the drive instructions and stop instructions. The data "10B" is set to the conveyance information of the page information given to the conveyance management processing at step 1211, thereby finishing the conveyance processing.

At the jamming processing at step 1215, the data "11B" is set to the conveyance information of the page information given, thereby setting the respective jamming types to the error information areas, not shown, and finishing the conveyance processing.

(iv) Stapling Conveying Processing

With the flowchart shown in FIG. 14, the stapling conveying processing is described next. First, a timer begins at step 1301. Next, a drive start instruction for the conveyance motor M1 is then given to the conveyance motor drive processing at step 1302. At step 1303, the descriptor of the page information is looked at, and it is judged whether it is the SOJ (start of job). If it is the SOJ, it means the first page of the job, and the processings from step 1304 to step 1312 described below are implemented.

First, the isolation motor M3 is driven at step 1304, and the bundle delivery roller pair 5 as a bundle delivering means that in a nipping state at the initializing processing is separated. A prescribed time is waited at step 1305 to wait for the completion of the isolation operation, and the isolation motor M3 is stopped at step 1306. The alignment motor M4 is driven at step 1307, and the alignment plate 6 as aligning means is moved to a waiting position B.

The reason that the bundle delivery roller pair 5 is temporarily isolated at step 1304 is that the sheet conveyance may be disturbed where the fully stacking detection sensor flag 10 moving to the escaping position by the bundle delivery upper roller 5U is suspended by the alignment plate 6 if the alignment plate 6 is moved to the waiting position B without the isolation.

After the moving completion of the alignment plate 6 to the waiting position B is waited with a prescribed period at step 1308, the alignment motor M4 is stopped at step 1309, and the isolation motor M3 is driven to nip again the bundle delivery roller pair 5 that has been isolated at step 1310. The completion of the nipping movement is waited with a prescribed time at step 1311, and the isolation motor M3 is stopped at step 1312.

Next, the inlet sensor 1 is confirmed at step 1313, and it is found whether the sheet is loaded in the delivery processing apparatus B. If it is not loaded, the timer value is confirmed at step 1314, and if it passes a prescribed time or more, it is judged as delayed jamming, thereby implementing jamming processing at step 1327. If it is within the prescribed time, the operation returns to the processing at step 1313.

In a meantime, when the sheet is detected at step 1313, the inlet sensor 1 is confirmed at step 1315 to find out the rear end of the sheet. If the rear end is not found out, the timer value is confirmed at step 1316, and if it passes a prescribed time set for each sheet size or more, it is judged as remaining jamming to implement jamming processing at step 1327. If it is within the prescribed time, the operation returns to the processing at step 1315. At that time, the front end of the first sheet S1 (SOJ) is loaded in the alignment plate 6 as the bundle delivery roller pair 5 is in the nipping state (conveyable state).

Where the rear end of the sheet is detected at step 1315, the timer counter is reset at step 1317 to start newly counting up. The descriptor of the page information is looked again at step 1318, and it is judged as whether it is the SOJ. If it is the SOJ, the isolation motor M3 is drive to isolate the bundle delivery roller pair 5 at step 1319. At step 1320, the completion of the nipping movement is waited with a prescribed time, and the isolation motor M3 is stopped at step 1312.

With the stapling conveyance, the sheets are stacked on the alignment stage 4 one by one to implement the alignment operation. If the bundle delivery roller pair 5 is nipped at that time, the sheet may be delivered out of the alignment stage 4 because the conveyance motor M1 is driving. To avoid this, the bundle delivery roller pair 5 is isolated during loading of the second or later sheets.

Figure 15:
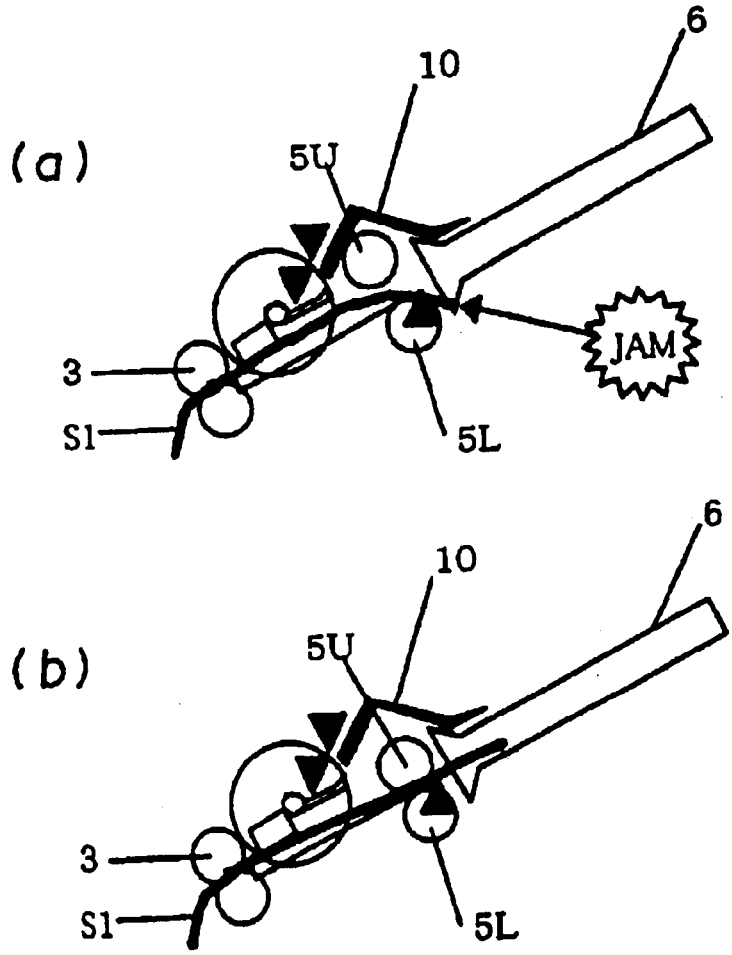
FIGS. 15(*a*) and 15(*b*) are illustrations of the bundle delivery roller's state when the first sheet is conveyed to the alignment stage.

The reason that the bundle delivery roller pair 5 nips only the first sheet of a job is illustrated using FIGS. 15(*a*) and 15(*b*). The sheet loaded out of the printer is a sheet passing through a thermally fixing unit 112 and has a considerable curling amount. If the sheet is conveyed as the bundle delivery roller pair 5 is isolated, the sheet S1 may move out of a conveyance route gap located between the bundle delivery roller pair 5 and the inlet of the alignment plate 6 as shown in FIG. 15(*a*), so that the sheet may enter below the alignment plate 6.

The bundle delivery roller pair 5 is composed of alternatively the bundle delivery upper roller 5U and the bundle delivery lower roller 5L, and the sheet may generate a strong rigidity when the bundle delivery roller pair 5 conveys the sheet, so that the sheet is conveyed straightly by the alignment plate 6 as shown in FIG. 15(*b*). Therefore, only the first sheet is conveyed with processing in nipping the bundle delivery roller pair 5.

On the other hand, the subsequent sheets of the second or later can be conveyed smoothly to the side of the alignment plate 6 without subjecting to jamming even where the bundle delivery roller pair 5 is isolated (non-conveyable state), because the preceding first sheet S1 plays a role to bridge between the bundle delivery roller pair 5 and the alignment plate 6, so that the sheets can be stacked on the alignment stage 4.

Figure 14:
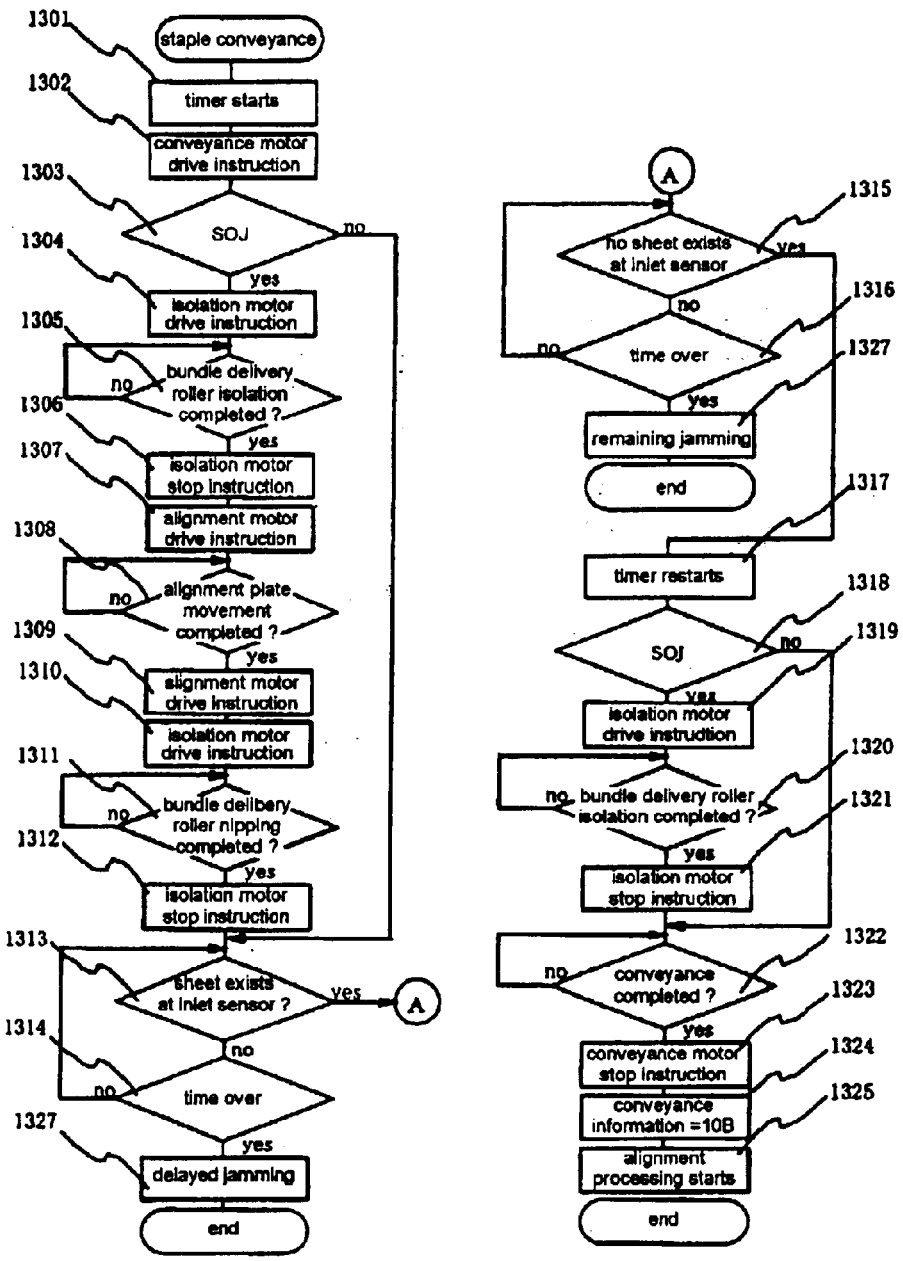
FIG. 14 is a flowchart showing a staple conveyance processing.

A prescribed time until the sheet is stacked on the alignment stage 4 is waited at step 1322 in FIG. 14, and the stop instruction of the conveyance motor M1 is given to the conveyance motor drive processing at step 1323. A data of "10B" is set to the conveyance information of the page information given from the conveyance management processing, thereby finishing the conveyance processing.

A alignment processing task for performing an alignment operation at step 1325 is started with an address of the page information, and the stable conveyance processing is finished.

A data "11" is set to the conveyance information of the given page information at the jamming processing at step 1327, thereby setting the respective jamming types to the error information areas, not shown, and finishing the conveyance processing.

(v) Alignment Processing

Figure 16:
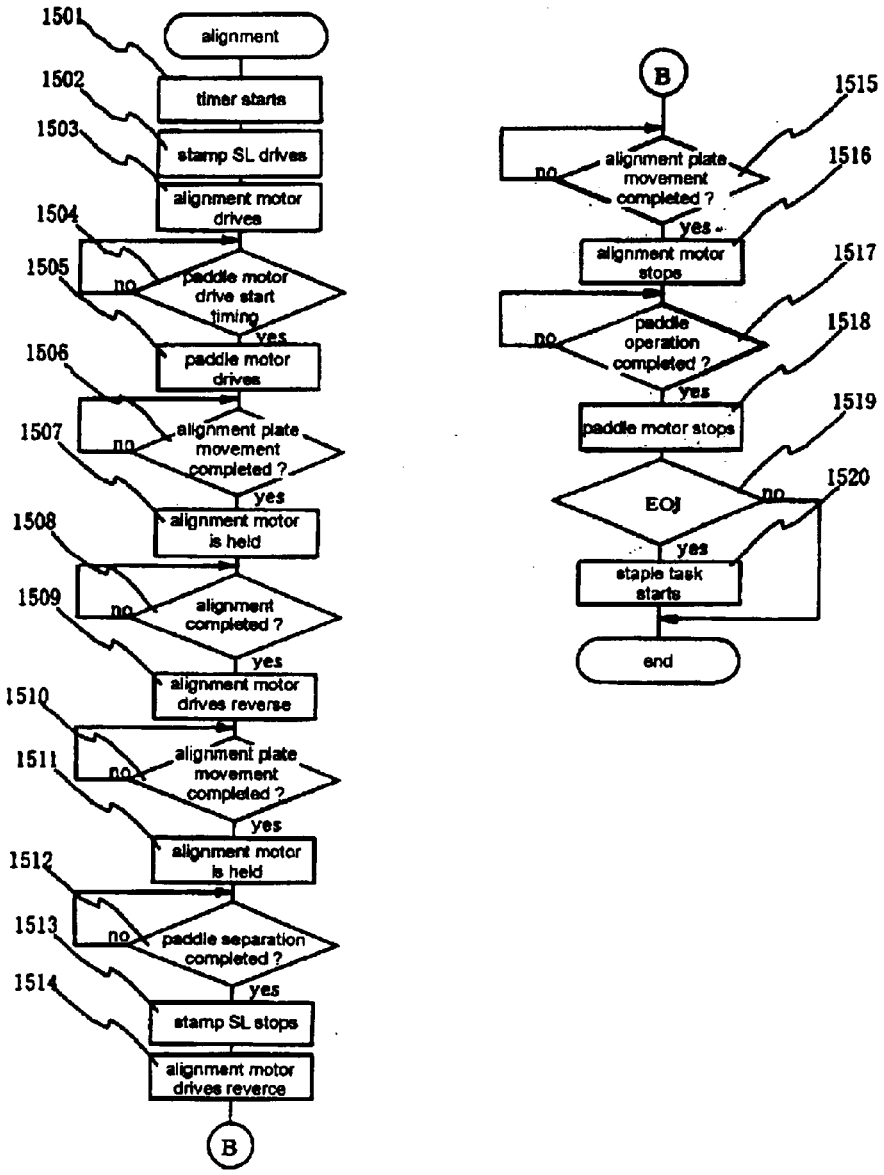
FIG. 16 is a flowchart showing an aligning processing.
Figure 17:
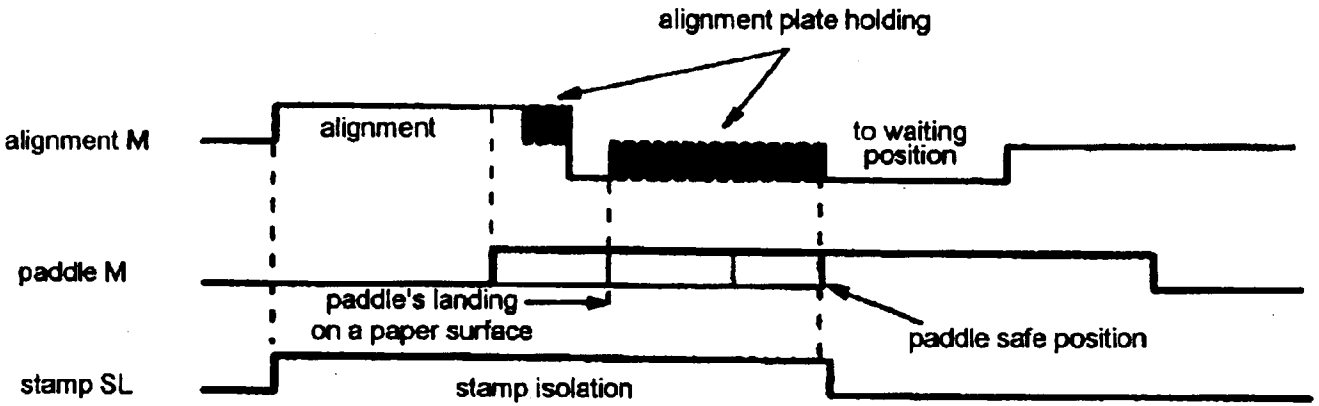
FIG. 17 is a timing chart in the aligning processing.

FIG. 16 is a flowchart showing an alignment processing. FIG. 17 is a timing chart in the alignment processing. A timer begins at step 1501. The stamp solenoid SL is started to operate at step 1502, and immediately the alignment motor M4 is driven at step 1503 to move the alignment plate 6 to the alignment position C. Normally, the processing at step 1503 is done after the stamp 9 is completely isolated, but there would be no problem even where the solenoid SL and the alignment motor M4 are drive simultaneously because the time that the stamp 9 completes the isolation is adequately shorter than the time that the alignment plate 6 completes the movement to the alignment position C. If the stamp 9 interferes with sheets to be aligned, a delay time may be provided for adjustment between the processing at step 1502 and the processing at step 1503.

The timer is confirmed at step 1504 to wait for a prescribed time, and the paddle motor M2 is driven in order to rotate the paddle 8 at step 1505. Next, a prescribed time is waited to render the alignment plate 6 reach the alignment position C at step 1506, and the alignment motor M4 is held at step 1507. Another prescribed time is further waited at step 1508, and the alignment motor M4 is rotated in the reverse direction to move the alignment plate 6 to a position C' slightly opened from the alignment position C of the alignment plate 6 (see, FIG. 3). A prescribed time is further waited at step 1510, and the alignment motor M4 is held at step 1511. The alignment motor holding processing is a processing immobilizing the rotator of the motor by sending periodically the same exciting pattern to the stepping motor. At that time, the tip of the paddle 8 rotating at the paddle motor M2 at step 1505 lands on a sheet on the alignment stage 4, and pulls back the sheet projected from the alignment stage 4 as it is. That is, performed is a sequence in which: the stamp 9 is isolated from the sheet surface, and the alignment in the width direction is performed; at the time when the alignment in the width direction is finished, the alignment plate 6 is slightly opened to allow the paddle 8 to align the sheets in the longitudinal direction. The reason that the alignment plate 6 is made open at the time that the paddle 8 makes alignment in the longitudinal direction is to prevent the sheets from not being pulled back due to frictional force between the alignment plate 6 and the sheet.

A prescribed time is waited until the paddle 8 sets apart from the sheet surface at step 1512, and the drive of the solenoid SL is stopped as to press with the stamp 9 the aligned sheets at step 1513. Because the bundle aligned with the stamp 9 is pressed, the topmost sheet of the sheet bundle aligned by the sheets can be prevented from being pushed out even where the subsequent curling sheet is loaded on the alignment stage 4. The alignment motor M4 that has held at step 1514 is further rotated in the reverse direction to return the alignment plate 6 to the waiting position B. At step 1515 processing waits the alignment plate 6 going back to the home position and at step 1516 processing stops the alignment motor.

With those processings in series, the subsequent processing can be done one by one after completion of a previous processing. Where the printer operates faster and where the sheet interval cannot be taken adequately, those processings in series have to be done within a short time. Accordingly, in this invention, the alignment processing can be finished with the shortest time in consideration of the operation time such as the processings at steps 1502, 1503, steps 1505, 1507, and step 1509.

A prescribed time is waited until the paddle 8 returns to the original home position at step 1517, and the paddle motor is stopped at step 1518. As mentioned, all the alignment jobs are finished.

At step 1519 the descriptor of the page information is looked at, and it is judged as to whether the page subjecting to the alignment processing is the EOJ (end of page). If it is not the EOJ, this alignment processing is completed. If it is the EOJ, the stapling processing task is started to operate with the address of the page information to implement the stapling processing at step 1520, thereby finishing this alignment operation.

It is to be noted that although a description is omitted, the motor malfunction detected in the initializing processing as described above in (i) is also done in this alignment operation, and when malfunction is found, substantially the same malfunction processing is done.

(vi) Stapling Processing

Figure 18:
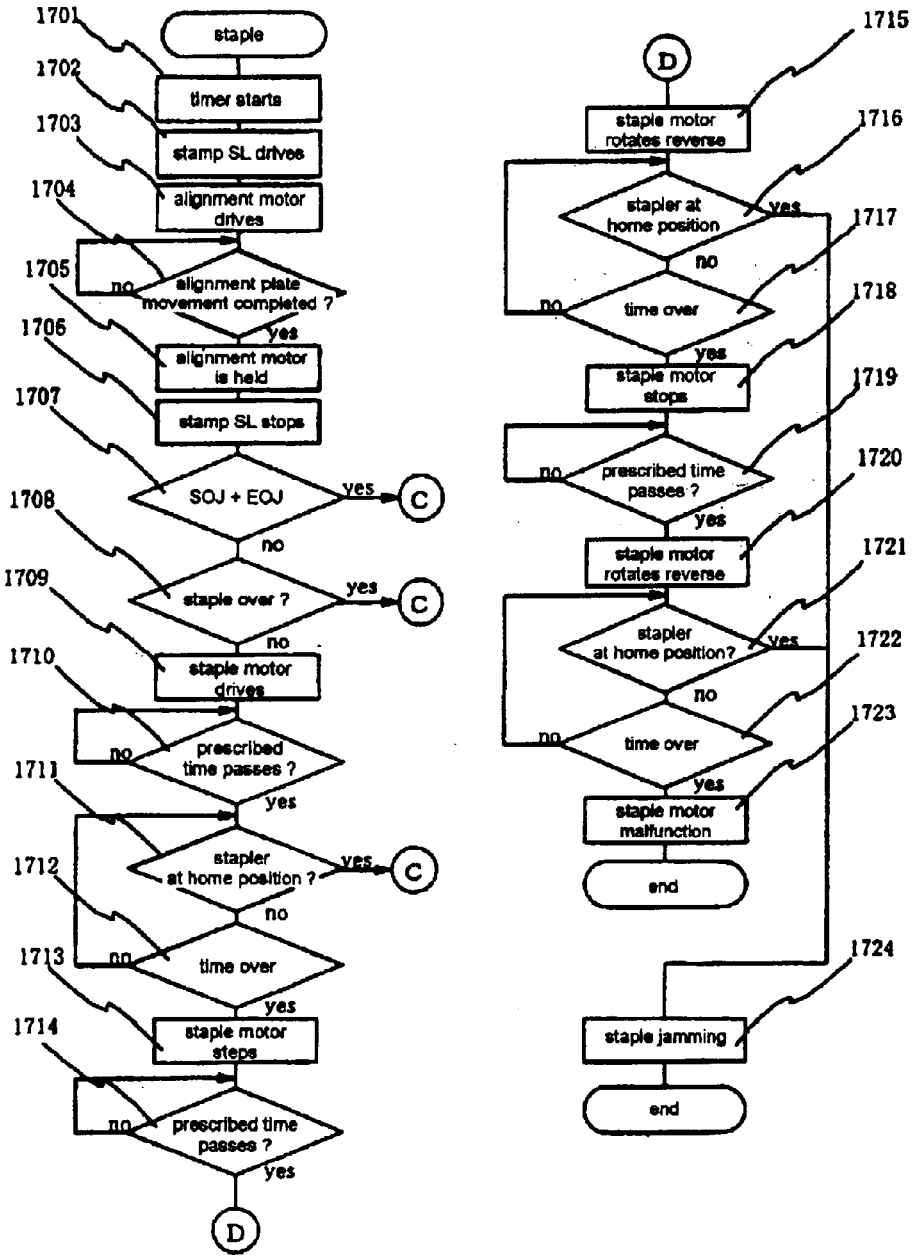
FIG. 18 is a flowchart showing a staple processing.
Figure 19:
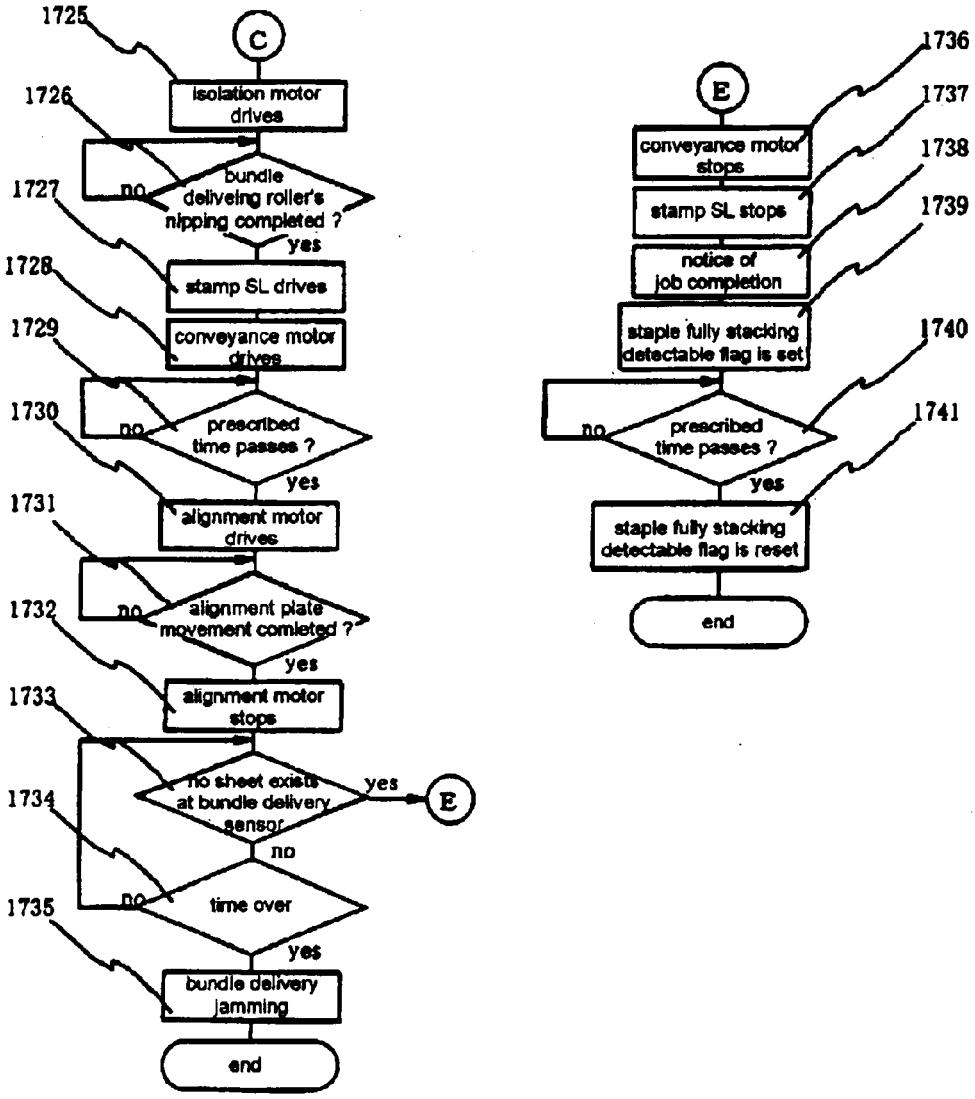
FIG. 19 is a flowchart showing a staple processing.

FIG. 18, FIG. 19 are flowcharts showing the stapling processing. A timer begins at step 1701. The stamp is isolated by driving the stamp solenoid at step 1702, and the alignment motor M4 is driven at step 1703 to move the alignment plate 6 to the alignment positions. A prescribed time is waited for the movement completion of the alignment plate 6 at step 1704, and the alignment motor M4 is held at step 1705. The stamp solenoid is stopped driving at step 1706 to press the stamp on the sheet bundle.

The descriptor of the page information is looked at step 1707, and a confirmation is made as to whether the SOJ and the EOJ exist, or namely whether it is one sheet stapling or not. If it is the SOJ and the EOJ, the operation moves to the processing at step 1725 because no stapling is made. If it is not one sheet stapling, it is judged as to whether it is an over-stapling in reference to the error information at step 1708. The over-stapling processing is described later. If it is the over-stapling, the operation moves to the processing at step 1725 since no stapling is made. If it is not the over-stapling, the stapling motor is driven to make stapling at step 1709. A prescribed time is waited at step 1710, and the detection of the stapler home position, indicating the stapling completion, is confirmed at step 1711. If no home position is detected, a confirmation is made as to whether a prescribed time passes at step 1712, and if it is not passed, the operation returns to the processing at step 1711.

Where it is judged as the prescribed time passes at step 1712, the staple motor is stopped at step 1713, and another prescribed time is waited at step 1714 to drive the staple motor in the reverse direction at step 1715. At step 1716, again the detection of the stapler home position is confirmed. If the home position is not detected, a confirmation is made as to whether a prescribed time passes at step 1717, and if it is not passed, the operation returns to the processing at step 1716. If the prescribed time is passed, the staple motor is stopped at step 1718, and a prescribed time is waited at step 1719 to drive the staple motor in the reverse direction at step 1720. The detection of the stapler home position is confirmed again at step 1721. If the home position is not detected, a confirmation is made as to whether a prescribed time passes, and if not passed, the operation returns to the processing at step 1721.

If the prescribed time passes at step 1722, it is judged as the malfunction of the staple motor, and the malfunction processing is done at step 1723. Where the stapler home position is detected at steps 1716 and 1721, it is judged as occurrence of staple jamming, and staple jamming processing is done at step 1724.

If the stapler home position is detected at step 1711, it is judged as that the staple operation is normally finished, and the isolation motor M3 is driven at step 1725. After a prescribed time is waited for the nipping completion of the bundle delivery rollers, the stamp solenoid is driven again at step 1727, and the conveyance motor M1 is driven at step 1728, thereby starting the delivery operation of the stapled sheet bundle. A prescribed time is waited at step 1729, and the alignment motor M4 is driven rotating in the reverse direction at step 1730, thereby beginning the movement of the alignment plate 6 to the escaping position A. A prescribed time is waited at step 1731 to wait for the moving completion of the alignment plate 6 to the escaping position A, and the alignment motor is stopped at step 1732. The bundle delivery sensor is monitored at step 1733, and a confirmation is made as to whether the sheet bundle is delivered. If the time is over at step 1734, the bundle delivery jamming processing is made at step 1735.

When the bundle delivery completion is detected at step 1733, the conveyance motor is stopped at step 1736, and the stamp solenoid is stopped driving at step 1737, and the job completion is informed to the printer controller not shown at step 1738.

To do the fully stacking detection processing, the staple fully stacking detection flag is set at step 1739, and the prescribed detection time is waited at step 1740 to reset the staple fully stacking detection flag at step 1741.

With the above operations, the stapling processing finishes.

(vii) Over-stapling Processing

The stapling apparatus has a stapling permissive number of sheets. This apparatus is for fifteen sheets. Sheet number designation more than the stapling permissive sheet number, however, may be done in a job designated by a user. In such a case, overloading of the stapling permissive sheet number is protected by any of the printer driver, the printer controller, and the delivery processing apparatus B. In this invention, the protecting method using the delivery processing apparatus B is described.

Figure 20:
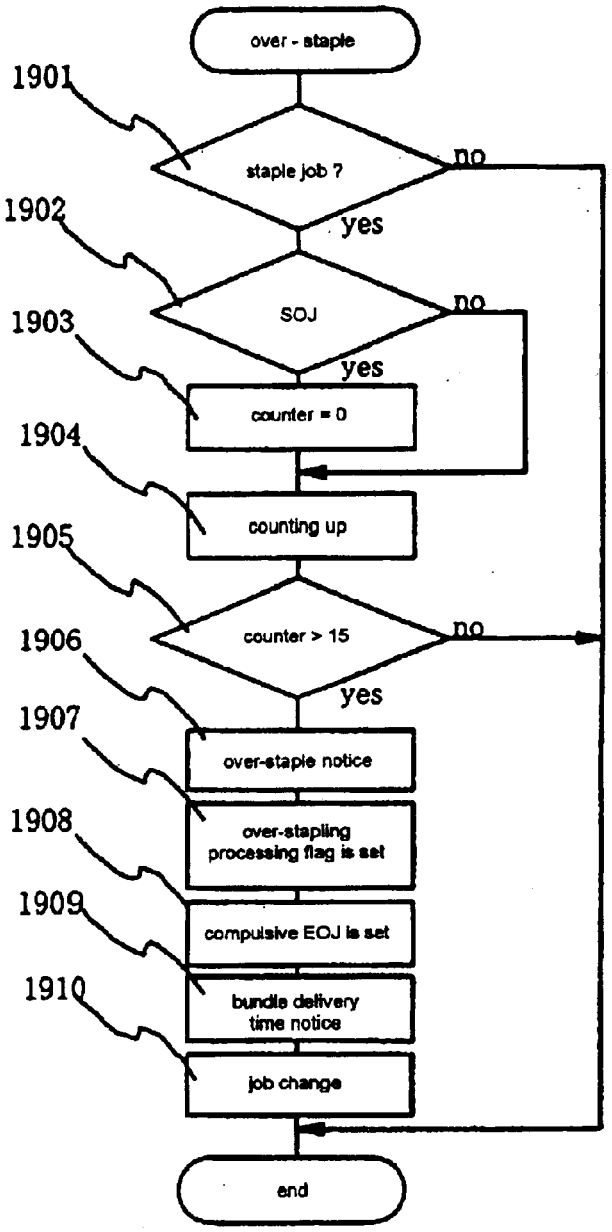
FIG. 20 is a flowchart showing a staple over processing at the CPU.

FIG. 20 is a flowchart showing the over-stapling processing. This processing is done immediately before the page information registration to the conveyance management table at step 1003 in the sheet conveyance management processing shown in FIG. 11.

First, the memorized job information is confirmed at step 1901, and if it is not the staple job, the following checks are omitted. If it is the staple job, the descriptor of the page information is confirmed at step 1902, and if it is the SOJ, a staple sheet number counter is initialized to zero at step 1903. At step 1904, the staple sheet number counter is counted up and memorized. A judgment is made at step 1905 as to whether the staple sheet number thus counted up exceeds the staple permissive sheet number. If it exceeds the staple permissive sheet number, the over-stapling operation is informed to the printer controller at step 1906, and an over-stapling processing ongoing flag is set and stored to do the over-stapling processing to the subsequent sheets at step 1907. The EOJ is additionally written compulsively at step 1908 to the page information in the conveyance management table immediately prior to the sheet detected the over-stapling operation. This enables the bundle delivery without drive of the staple motor in the stapling processing shown in FIG. 18, FIG. 19.

The necessary time for implementing the bundle delivery processing is informed at step 1909 to the printer controller together with the page ID of a sheet subsequent to the sheet in which the EOJ is compulsively set at step 1908. The stored job information is replaced with the simple stacking job compulsively at step 1920. With this replacement, when the page information is registered to the conveyance management table at step 1003 of the sheet conveyance management processing shown in FIG. 11, the page information is written thereafter in the conveyance management table as the simple stacking job in respect to the pages immediately before the SOJ in the subsequent job.

With the processings thus described, the job for sheet number more than the staple permissive sheet number can be protected, and this processing can prevent the stapler from receiving damages due to stapling out of the specification.

(viii) Fully Stacking Detection Processing

As described above, where the bundle delivery upper roller 5U is isolated from the bundle delivery lower roller 5L, the fully stacking detection sensor flag 10 is in a non-detection state. Where the delivery processing apparatus B executes the staple job or where the sheets are stacked on the alignment stage 4 for the stapling job, the stacking state on the stacking tray 7 can be detected. A control is required to detect the delivery stacking amount on the stacking tray 7 at least only when the following two conditions are satisfied. The conditions are: first, the bundle delivery roller pair 5 is in a nipping state, and second, the alignment plate 6 is at the home position.

In a case of the simple delivery, the conveyance interval is very short between the proceeding sheet and the subsequent sheet, and therefore, an erroneous judgment (such as judgment for fully stacking where the sheets are actually not fully stacked) may be made if the stacking amount is detected in a very short time. On the other hand, in a case which the stapled sheet bundle is stacked on the stacking tray 7, because the sheet bundle is so thick, it may be judged as the fully stacking state if the stacking amount is detected with substantially longer time, and the sheet bundles stacked may pile up the delivery opening until the conveyance creases.

In consideration of the above problems, the fully stacking detection method has to be changed according to the delivery mode, namely the simple delivery mode and the stapling delivery mode, as well as according to a state that sheets are conveyed and a standby state.

Figure 21:
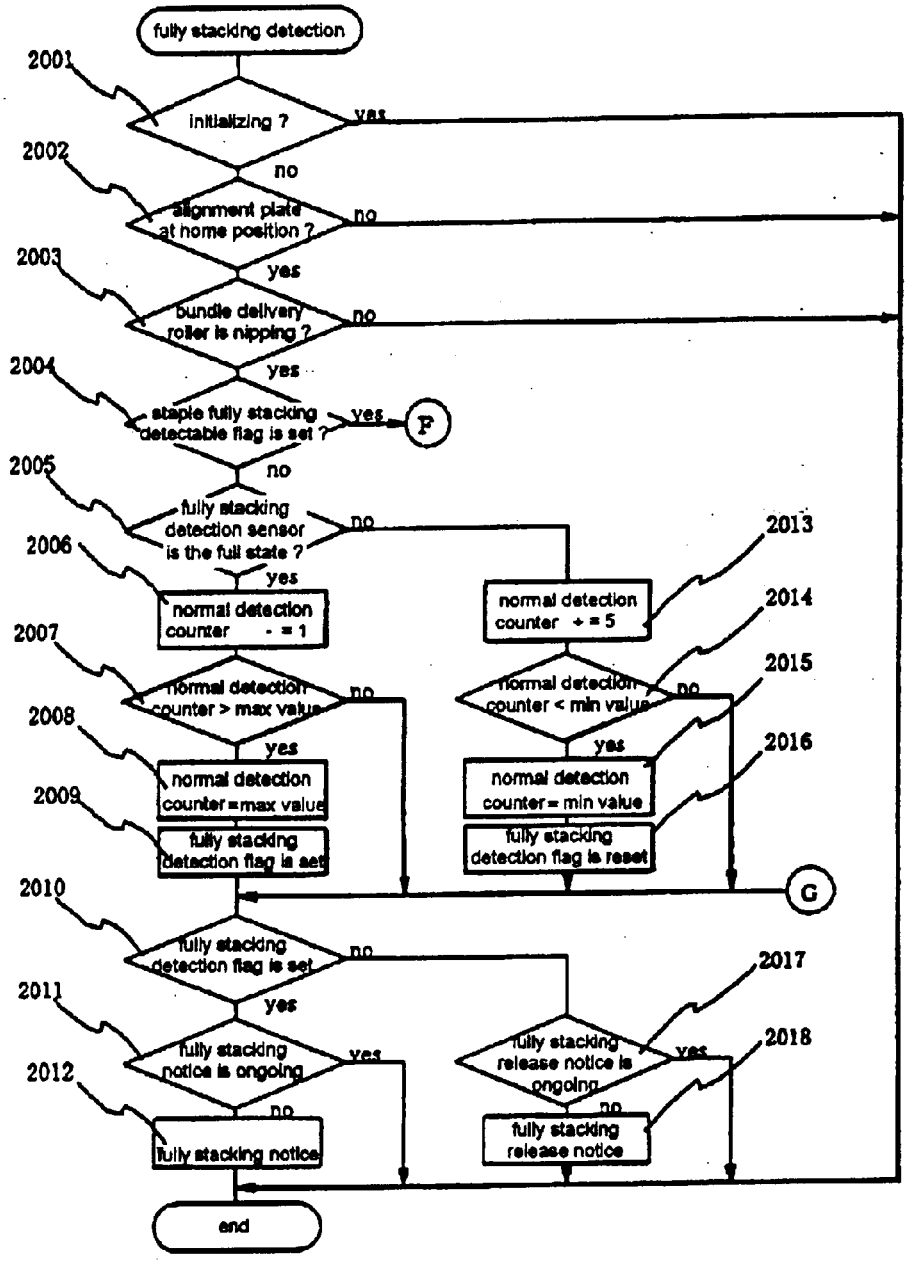
FIG. 21 is a flowchart showing a fully stacking detection processing.
Figure 22:
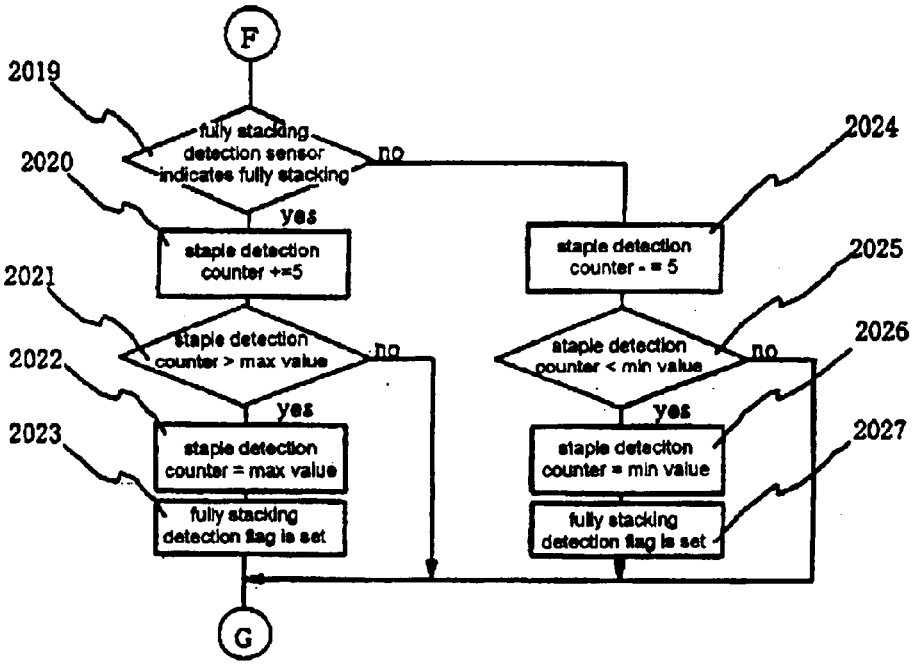
FIG. 22 is a flowchart showing the fully stacking detection processing.

FIG. 21 and FIG. 22 are flowcharts showing the fully stacking detection processings, and it is processed as a task independent of other processings.

At step 2001, a judgment is made as to whether the delivery processing apparatus B is in an initializing state, and if it is in the initializing state, the fully stacking detection is not made. A confirmation is made as that the alignment plate 6 is at the home position at step 2002 as the fully stacking condition, and another confirmation is made as that the bundle delivery roller pair 5 is in a nipping state at step 2003. If it is out of the conditions, the fully stacking detection is not implemented.

A staple fully stacking detectable flag set at the stapling processing is confirmed at step 2004, and if it is set, the operation moves to the processing at step 2019 to detect fully stacking during the stapling operation. If the flag is reset, the fully stacking detection sensor 13 is confirmed at step 2005. If it is fully stacked, the fully stacking detection counter for simple stacking is one up at step 2006. A judgment is made as to whether passing time of a sheet passing at step 2007 exceeds the maximum value previously stored in this counter; if it exceeds, a maximum value is written in the counter at step 2008; the fully stacking detection sensor flag 10 is set at step 2009 (the fully stacking state is confirmed).

If the fully stacking state is not detected at step 2005, the fully stacking detection counter for the simple stacking is five down at step 2013, and a judgment is made as to whether this counter value becomes lower than the minimum value previously memorized. If it is lower, the minimum value is written over the counter at step 2015, and the fully stacking detection sensor flag 10 is reset at step 2016 (the non-fully stacking state is confirmed).

That is, this processing is done for the purpose of performing slowly at the fully stacking detection time during the simple stacking period and quickly at the fully stacking releasing detection time, and therefore, the maximum value and the counter up value are set so as to be larger than the time that the maximum size sheet dealt with this delivery processing apparatus B passes by the fully stacking detection sensor flag with the slowest conveyance speed. The minimum value and the counter down value are set so as to detect the fully stacking release within a time of the shortest sheet interval. With such a processing, the fully stacking state can be found out without regarding whether the sheet is passing by the fully stacking detection sensor flag or not.

The fully stacking detection sensor flag 10 is confirmed at step 2010, and if it is set, a judgment is made at step 2011 as to whether the fully stacking state is already informed to the printer controller. If it is not yet informed, the fully stacking state is informed to the printer controller at step 2012. If it is reset at step 2010, a judgment is made at step 2017 as to whether fully stacking release is already informed to the printer controller. If it is not yet informed, the fully stacking release is informed to the printer controller at step 2018.

If the staple fully stacking detectable flag is set at step 2004, the fully stacking detection sensor 13 is confirmed at step 2019. If it is the fully stacking state, the fully stacking detection counter for stapling operation is increased five value at step 2020, and a judgment is made at step 2021 as to whether this counter exceeds the maximum value previously memorized. If it is exceeding, the maximum value is written in the counter at step 2022, and the fully stacking detection sensor flag is set at step 2023. If the fully stacking state is not detected, the fully stacking detection counter for stapling operation is reduced five value at step 2024, and a judgment is made at step 2025 as to whether this counter become lower than the minimum value previously memorized. If it is lower, the minimum value is written in the counter at step 2026, and the fully stacking detection sensor flag is reset at step 2027.

That is, in this processing, the fully stacking detection during stapling operation is designed to done quickly because the job interval time is limited during the fully stacking release detection time, and the maximum value and the counter up value, as well as the minimum value and the counter down value are so set that the fully stacking detection and the fully stacking release detection can be done within the shortest job interval time. In this invention, it is set to the sheet interval time during simple stacking or less.

It is to be noted that in the embodiments described above, the stapling mechanism is exemplified as a sheet processing means, but it can be other mechanisms such as means for punching processing or the like.

What is claimed is:

1. A delivery processing apparatus for delivering a sheet after performing a prescribed sheet processing upon aligning the sheet, comprising:

a sheet stacking portion on which a sheet to be processed is stacked;

an aligning means for aligning a sheet which is disposed at a gap from the sheet stacking portion downstream of the sheet stacking portion in a sheet conveyance direction and aligns a sheet staked on the sheet stacking portion in a direction perpendicular to the sheet conveyance direction;

a conveying means for conveying a sheet to the aligning means and the sheet stacking portion; and a delivering means disposed downstream of the conveying means in the sheet conveyance direction and upstream of the aligning means in the sheet conveyance direction for delivering processed sheets, wherein the delivering means is able to choose a conveyable state for conveying a sheet upon nipping the sheet and a non-conveyable state for not conveying a sheet, wherein when a first sheet among a plurality of sheets to be conveyed to the aligning means by the conveying means is conveyed, the conveyable state is chosen, and whereas when second and subsequent sheets are conveyed, the non-conveyable state is chosen.

2. The delivery processing apparatus according to claim 1, wherein the first sheet conveyed by the delivering means covers the gap and bridges between the sheet stacking portion and the aligning means.

3. The delivery processing apparatus according to claim 1, wherein the delivering means includes a first roller group and a second roller group, and wherein positions of the first roller group and the second roller group are set alternatively.

4. The delivery processing apparatus according to claim 1, wherein the aligning means includes a sheet stacking surface and is movable between a first position for supporting a sheet and a second position for not supporting a sheet.

5. The delivery processing apparatus according to claim 1 or claim 2, wherein the conveyable state of the delivering means continues until such time that the first sheet reaches the aligning means.

6. An image forming apparatus, comprising:

an image forming portion for forming an image on a sheet; and a delivery processing apparatus for delivering the sheet on which an image is formed after performing a prescribed sheet processing upon aligning the sheet, wherein the delivery processing apparatus comprises:

a sheet stacking portion on which a sheet to be processed is stacked;

an aligning means for aligning a sheet which is disposed by a gap from the sheet stacking portion downstream of the sheet stacking portion in a sheet conveyance direction and aligns a sheet stacked on the sheet stacking portion in a direction perpendicular to the sheet conveyance direction;

a conveying means for conveying a sheet to the aligning means and the sheet stacking portion; and a delivering means disposed downstream of the conveying means in the sheet conveyance direction and upstream of the aligning means in the sheet conveyance direction for delivering processed sheets, wherein the delivering means is able to choose a conveyable state for conveying a sheet upon nipping the sheet and a non-conveyable state for not conveying a sheet, wherein when a first sheet among a plurality of sheets to be conveyed to the aligning means by the conveying means is conveyed, the conveyable state is chosen, and whereas when second and subsequent sheets are conveyed, the non-conveyable state is chosen.

7. The image forming apparatus according to claim 6, wherein the first sheet conveyed by the delivering means covers the gap and bridges between the sheet stacking portion and the aligning means.

8. The image forming apparatus according to claim 6, wherein the delivering means includes a first roller group and a second roller group and the first roller group and the second roller group are set alternatively.

9. The image forming apparatus according to claim 6, wherein the aligning means includes a sheet stacking surface and is movable between a first position where a sheet is supported and a second position where a sheet is not supported.

10. The image forming apparatus according to claim 6 or claim 7, wherein the conveyable state of the delivery means is continued until such time that the first sheet reaches the aligning means.

11. A delivery processing apparatus which delivers a sheet after implementing a prescribed sheet processing upon aligning the sheet, comprising:

a sheet stacking portion on which a sheet to be processed is stacked;

aligning plates which is disposed at a gap from the sheet stacking portion downstream of the sheet stacking portion in a sheet conveyance direction and aligns a sheet stacked on the sheet stacking portion in a direction perpendicular to the sheet conveyance direction;

a conveying roller which conveys a sheet to the aligning plates and the sheet stacking portion; and a delivering roller pair disposed downstream of the conveying roller in the sheet conveyance direction and upsteam of the aligning plates in the sheet conveyance direction for delivering processed sheets, wherein the delivering roller pair is able to choose a conveyable state for conveying a sheet upon nipping the sheet and a non-conveyable state for not conveying a sheet, and wherein when a first sheet among a plurality of sheets to be conveyed to the aligning plates by the conveying roller is conveyed, the conveyable state is chosen, and whereas when second or subsequent sheets are conveyed, the non-conveyable state is chosen.

12. The delivery processing apparatus according to claim 11, wherein the first sheet conveyed by the delivering roller pair covers the gap and bridges between the sheet stacking portion and the aligning plates.

13. The delivery processing apparatus according to claim 11, wherein the delivering roller pair includes a first roller group and the other roller group, and the one roller group and the other roller group are set alternatively.

14. The delivery processing apparatus according to claim 11, wherein the aligning plates includes a sheet stacking surface and is movable between a first position where a sheet is supported and a second position where a sheet is not supported.

15. The delivery processing apparatus according to claim 11 or 12, wherein the conveyable state of the delivery roller pair is continued by a time that the first sheet reaches the aligning plates.

16. An image forming apparatus, comprising:

an image forming portion which forms an image on a sheet; and a delivery processing apparatus which delivers the sheet on which an image is formed after performing a prescribed sheet processing upon aligning the sheet, wherein the delivery processing apparatus comprises:

a sheet stacking portion on which a sheet to be processed is stacked;

aligning plates which is disposed at a gap from the sheet stacking portion downstream of the sheet stacking portion in a sheet conveyance direction and aligns a sheet stacked on the sheet stacking portion in a direction perpendicular to the sheet conveyance direction;

a conveying roller which conveys the sheet to the aligning plates and the sheet stacking portion; and a delivering roller pair disposed downstream of the conveying roller in the sheet conveyance direction and upstream of the aligning plates in the sheet conveyance direction for delivering processed sheet, wherein the delivering roller pair is able to choose a conveyable state for conveying a sheet upon nipping the sheet and a non-conveyable state for not conveying a sheet, wherein when a first sheet among a plurality of sheets to be conveyed to the aligning plates by the conveying roller is conveyed, the conveyable state is chosen, and whereas when second or subsequent sheets are conveyed, the non-conveyable state is chosen.

17. The image forming apparatus according to claim 16, wherein the first sheet conveyed by the delivering roller pair covers the gap and bridges between the sheet stacking portion and the aligning plates.

18. The image forming apparatus according to claim 16, wherein the delivering roller pair includes a first roller group and a second roller group, and the first roller group and the second roller group are set alternatively.

19. The image forming apparatus according to claim 16, wherein the aligning plates includes a sheet stacking surface and is movable between a first position where a sheet is supported and a second position where a sheet is not supported.

20. The image forming apparatus according to claim 16 or 17, wherein the conveyable state of the delivering roller pair continues until such time that the first sheet reaches the aligning plates.

* * * * *

UNITED STATES PATENT AND TRADEMARK OFFICE

CERTIFICATE OF CORRECTION

PATENT NO. : 7,055,815 B2
APPLICATION NO. : 10/410202
DATED : June 6, 2006
INVENTOR(S) : Kaoru Sato It is certified that error appears in the above-identified patent and that said Letters Patent is hereby corrected as shown below:

On Title Page

[*] Notice: Subject to any disclaimer, the term of this patent is extended or adjusted under 35 USC 154(b) by (205) days Delete the phrase "by 205 days" and insert -- by 300 days--

Signed and Sealed this

Thirtieth Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,055,815 B2
APPLICATION NO. : 10/410202
DATED : June 6, 2006
INVENTOR(S) : Kaoru Sato et al.

It is certified that error appears in the above-identified patent and that said Letters Patent is hereby corrected as shown below:

In The Drawings

SHEET NO. 9 of 22:
Figure 9, “malfanction” (both occurrences) should read --malfunction--.

SHEET NO. 10 of 22:
Figure 10, “malfanction” should read --malfunction--.

COLUMN 2:
Line 25, “an” should read --a--.
Line 40, “an” should read --a--.
Line 43, “initialing” should read --initializing--.1

COLUMN 3:
Line 12, “an” should read --a--.
Line 32, “feeds” should read --feed--.

COLUMN 5:
Line 3, “to” (both occurrences) should read --with--.

COLUMN 7:
Line 13, “determined as” should read --determination that--.
Line 30, “determined as” should read --determination that--.

COLUMN 11:
Line 56, “drive” should read --driven--.

COLUMN 12:
Line 34, “A” should read --An--.
Line 52, “drive” should read --driven--.

COLUMN 13:
Line 41, “waited” should read --awaited--.

COLUMN 14:
Line 46, “waited” should read --awaited--.
Line 50, “waited” should read --awaited--.
Line 64, “waited” should read --awaited--.

UNITED STATES PATENT AND TRADEMARK OFFICE

CERTIFICATE OF CORRECTION

PATENT NO. : 7,055,815 B2
APPLICATION NO. : 10/410202
DATED : June 6, 2006
INVENTOR(S) : Kaoru Sato et al.

It is certified that error appears in the above-identified patent and that said Letters Patent is hereby corrected as shown below:

COLUMN 16:
Line 16, "as" should read --so--.
Line 19, "as" should read --so--.

COLUMN 17:
Line 13, "become" should read --becomes--.

COLUMN 18:
Line 66, "is" should read --are--.

COLUMN 19:
Line 27, "the other" should read --an other--; and "one" should read --first--.

Signed and Sealed this

Twentieth Day of March, 2007

JON W. DUDAS
*Director of the United States Patent and Trademark Office*